US008501317B2

(12) United States Patent
Miura

(10) Patent No.: US 8,501,317 B2
(45) Date of Patent: Aug. 6, 2013

(54) VARIABLE-AIRFLOW CLOTH, SOUND ABSORBING MATERIAL, AND VEHICULAR PART

(75) Inventor: Hiroaki Miura, Kamakura (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 1114 days.

(21) Appl. No.: 12/282,619

(22) PCT Filed: Mar. 13, 2007

(86) PCT No.: PCT/JP2007/054909

§ 371 (c)(1),
(2), (4) Date: Sep. 11, 2008

(87) PCT Pub. No.: WO2007/105710

PCT Pub. Date: Sep. 20, 2007

(65) Prior Publication Data

US 2009/0029620 A1 Jan. 29, 2009

(30) Foreign Application Priority Data

Mar. 16, 2006 (JP) ..... 2006-072628
Aug. 31, 2006 (JP) ..... 2006-236470

(51) Int. Cl.
*D02G 3/00* (2006.01)

(52) U.S. Cl.
USPC ..... 428/374; 428/364; 428/365; 428/369; 428/370; 428/371; 428/373; 442/199; 442/200; 442/301; 442/303; 442/311; 442/352; 442/353; 442/361; 442/362; 442/364; 442/414

(58) Field of Classification Search
USPC ..... 442/199, 301, 311, 362, 414, 200, 442/303, 352, 353, 361, 364; 428/364, 365, 428/369, 370, 371, 373, 374
See application file for complete search history.

(56) References Cited

U.S. PATENT DOCUMENTS

| | | | | |
|---|---|---|---|---|
| 6,951,899 | B2 | 10/2005 | Nakagome | |
| 7,087,660 | B2 | 8/2006 | Maier et al. | |
| 7,244,497 | B2 | 7/2007 | Hartmann et al. | |
| 7,291,389 | B1 * | 11/2007 | Bitler et al. | 428/373 |
| 2003/0124349 | A1 | 7/2003 | DeAngelis et al. | |
| 2005/0249917 | A1 | 11/2005 | Trentacosta et al. | |
| 2006/0050189 | A1 | 3/2006 | Ito et al. | |
| 2006/0076540 | A1 | 4/2006 | Zama et al. | |

FOREIGN PATENT DOCUMENTS

| | | | |
|---|---|---|---|
| DE | 10 2004 034 285 | A1 | 3/2005 |
| EP | 0 336 072 | A2 | 10/1989 |
| JP | 11-159443 | A | 6/1999 |

(Continued)

*Primary Examiner* — Andrew Piziali
(74) *Attorney, Agent, or Firm* — Foley & Lardner LLP

(57) ABSTRACT

Cloth, in which air permeability is variable by energization, includes: a fibrous object composed of composite fibers, each of the composite fibers including: an electrical-conductive polymeric material; and a material different from the electrical-conductive polymeric material, the different material being directly stacked on the electrical-conductive polymeric material; and electrodes which are attached to the fibrous object, and energize the electrical-conductive polymeric material. Each of the composite fibers has a structure in which the material different from the electrical-conductive polymeric material is stacked on at least a part of a surface of the electrical-conductive polymeric material, or a structure in which either one of the electrical-conductive polymeric material and the material different from the electrical-conductive polymeric material penetrates the other material in a longitudinal direction. The cloth is capable of controlling the air permeability by a control factor enabling weight reduction and space saving.

18 Claims, 29 Drawing Sheets

FOREIGN PATENT DOCUMENTS

| | | | |
|---|---|---|---|
| JP | 2004-510067 | A | 4/2004 |
| JP | 2004-162035 | A | 6/2004 |
| JP | 2004-188523 | A | 7/2004 |
| JP | 2005-23431 | A | 1/2005 |
| JP | 2005-503497 | A | 2/2005 |
| WO | WO 2005/047576 | A1 | 5/2005 |

* cited by examiner (a)

(b)

VARIABLE-AIRFLOW CLOTH, SOUND ABSORBING MATERIAL, AND VEHICULAR PART

TECHNICAL FIELD

The present invention relates to cloth in which air permeability is variable by energization. More specifically, the present invention relates to cloth in which the air permeability is reversibly varied by the energization, and to a sound absorbing material and a vehicular part, which use such cloth.

BACKGROUND ART

Heretofore, many functional materials have been developed. Among them, in functional commercial products, development in which a fiber material, a cloth structure, functional post-treatment and the like are combined has also be progressed positively in order to allow the products to develop higher and newer functions.

In new functional fibers in recent years, complexing and upgrading thereof have advanced. Moreover, in the apparel industry, many proposals have been made on fibers in which functions are changed in response to a change of a wearing environment, that is, which include so-called dynamic functionality. A thermal storage material that aims an enhancement of heat retention properties, which corresponds to an absorption amount of light energy, is an example of the dynamically functional fibers as described above.

As one of the functions thus specialized, an adjustment function for climate within clothing has been desired. In other word, so-called breathing clothing has been desired. In Japanese Patent Unexamined Publication No. 2005-23431, reversible-airflow cloth has been proposed, which controls a temperature and a humidity within the clothing in such a manner that air permeability of the clothing is reversibly changed in response to dynamic changes of the temperature, the humidity, moisture and the like within the clothing. This cloth has characteristics that the air permeability is reversibly changed by using materials in which a percentage of crimp is changed in response to the humidity and the moisture.

Each of these clothing materials is designed so that the air permeability can be optimized based on a difference between an external environment such as outdoor air temperature and humidity and an internal environment such as a body temperature and the humidity within the clothing. However, when the material is applied to other purposes, the change that is linked with the temperature and the humidity is not necessarily required in some case.

For example, in a non-woven fabric for use in a sound absorbing material and a sound insulating material, performance thereof regarding the sound absorption and insulation can be changed based on the air permeability. However, it is necessary for the non-woven fabric to have an adjustment function based on a controllable factor in order to obtain necessary sound absorbing performance in response to a noisy environment.

As a mechanical drive source capable of controlling the factor, a motor, hydraulic/pneumatic actuators and the like can be mentioned. However, in general, many of these mechanical drive sources are made of metal and largely occupy a mass and a space. Moreover, also in necessary power sources, there are many which require excessive energy.

Moreover, it is desirable that the material be made of a polymer in consideration that the material is used for the cloth, the non-woven fabric, the apparel and the like. In this viewpoint, there is known an electric deformation method using a pyrrole polymer that responds to stimulation (refer to Japanese Patent Unexamined Publication No. H11-159443).

Furthermore, as an example of an actuator using an organic material, which is obtained for the purpose of weight reduction and space saving, an electrical-conductive polymer described in Japanese Patent Unexamined Publication No. 2004-162035 is one to apply expansion and contraction of the organic material to the above-described subject by using an electrochemical oxidation-reduction reaction. However, a specific example of a shape thus obtained is a film shape, and only one example is shown, where an expansion-contraction direction thereof is a longitudinal direction.

Besides the above, as an example of an actuator formed by combination of a gel and a solvent, there is one described in Japanese Patent Unexamined Publication No. 2004-188523. However, in this example, a gel actuator that drives primarily in the solvent is made to drive in the air, and accordingly, it is necessary to hold, as a system, the actuator together with a solvent bath, and there is a possibility that a performance decrease owing to leakage of an electrolytic solution and to electrolysis may occur.

DISCLOSURE OF INVENTION

As described above, heretofore, cloth has not been able to be obtained, which is capable of controlling the air permeability in the form of the fabric, knit, the non-woven fabric and the like by a simple control factor.

The present invention has been made in consideration for the conventional problems as described above. It is an object of the present invention to obtain cloth capable of controlling the air permeability by a control factor enabling the weight reduction and the space saving in comparison with the conventional mechanical variable mechanism.

Cloth according to a first aspect of the present invention includes: a fibrous object composed of composite fibers, each of the composite fibers including: an electrical-conductive polymeric material; and a material different from the electrical-conductive polymeric material, the different material being directly stacked on the electrical-conductive polymeric material; and electrodes which are attached to the fibrous object, and energize the electrical-conductive polymeric material, wherein each of the composite fibers has a structure in which the material different from the electrical-conductive polymeric material is stacked on at least a part of a surface of the electrical-conductive polymeric material, or a structure in which either one of the electrical-conductive polymeric material and the material different from the electrical-conductive polymeric material penetrates the other material in a longitudinal direction.

A production method of cloth according to a second aspect of the present invention includes the steps of: mixing composite fibers and binder fibers with each other, wherein each of the composite fibers includes: an electrical-conductive polymeric material; and a material different from the electrical-conductive polymeric material, the different material being directly stacked on the electrical-conductive polymeric material, and has a structure in which the material different from the electrical-conductive polymeric material is stacked on at least a part of a surface of the electrical-conductive polymeric material, or a structure in which either one of the electrical-conductive polymeric material and the material different from the electrical-conductive polymeric material penetrates the other material in a longitudinal direction, and wherein each of the binder fibers includes a binder polymer having a softening point lower than a softening point of the composite fibers by at least 20° C., in which the softening point of the binder polymer is 70° C. or higher; forming a web by collecting the composite fibers and the binder fibers; compressing the web, and further heating the web at a temperature that is equal to or higher than the softening point of the binder fibers, and is equal to or lower than a temperature at which the composite fibers are not softened, thereby solidifying the web; and attaching electrodes to a solidified object of the composite fibers and the binder fibers, the electrodes energizing the electrical-conductive polymeric material.

Figure 1:
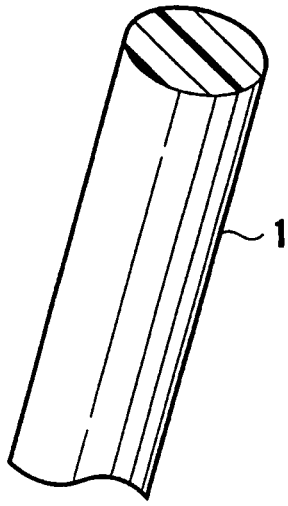
FIG. 1 is a schematic view showing a shape example of a conventional fiber.

BEST MODE FOR CARRYING OUT THE INVENTION (Variable-Airflow Cloth)

A description will be made below in detail of the present invention.

Variable-airflow cloth of the present invention is variable-airflow cloth in which air permeability is variable by energization. Then, the variable-airflow cloth includes at least a part of a fibrous object composed of composite fibers having a structure in which a material different from an electrical-conductive polymeric material is stacked on a part of a surface of the electrical-conductive polymeric material. Moreover, the variable-airflow cloth includes electrodes attached to the fibrous object. Here, as the fibrous object, one composed of single fibers of the composite fibers can be illustrated. Moreover, as the fibrous object, fiber bundles composed of the composite fibers can be illustrated. Furthermore, as the fibrous object, there can be illustrated fiber bundles including: the composite fibers having the structure in which the material different from the electrical-conductive polymeric material is stacked on a part of the surface of the electrical-conductive polymeric material; and according to needs, crimped yarns composed of a material that does not contain such an electrical-conductive polymer.

Alternatively, the variable-airflow cloth of the present invention includes at least a part of composite fibers including: an electrical-conductive polymeric material; and a material different from the electrical-conductive polymeric material, in which the composite fibers have a structure in which either one of the materials penetrates the other material in a longitudinal direction. Moreover, the variable-airflow cloth includes electrodes attached to the composite fibers.

Furthermore, a production method of variable-airflow cloth according to the present invention includes the steps of: mixing composite fibers and binder fibers with each other, wherein the composite fibers are at least either one of composite fibers having a structure in which a material different from an electrical-conductive polymeric material is stacked on a part of a surface of the electrical-conductive polymeric material, and of composite fibers including an electrical-conductive polymeric material and a material different from the electrical-conductive polymeric material, in which the composite fibers have a structure in which either one of the materials penetrates the other material in a longitudinal direction, and the binder fibers include a polymer having a softening point lower than a softening point of the composite fibers by at least 20° C., in which the softening point of the softening-point component is 70° C. or higher; forming a web by collecting the composite fibers and the binder fibers; subsequently compressing the web, and further heating the web at a temperature that is equal to or higher than the softening point of the binder fibers, and is equal to or lower than a temperature at which the composite fibers are not softened, thereby solidifying the web; and attaching electrodes to a solidified object of the composite fibers and the binder fibers, the electrodes energizing the electrical-conductive polymeric material.

Moreover, it is preferable that a change of the variable-airflow cloth be reversible.

A description will be sequentially made of the composite fibers for use in the present invention, and of the variable-airflow cloth using the composite fibers.

<Composite Fiber with Stack Structure>

The composite fiber in the present invention includes an electrical-conductive polymeric material, and has a structure in which a material different from the electrical-conductive polymeric material is stacked on a part of a surface of the electrical-conductive polymeric material. Moreover, the composite fiber itself can make motions, which are crimp-extension, by energization using current applying means for flowing a current through cloth using the composite fiber, which is controlling means for a quantity of airflow of the cloth. In such a way, it becomes possible to change the quantity of airflow of the cloth. Note that the composite fiber mentioned herein is characterized by including an electrical-conductive polymer, and having a structure in which a material different from the electrical-conductive polymer is stacked on the entirety or a part of a surface layer of the electrical-conductive polymer. Furthermore, the current applying means includes electrodes, and according to needs, lead wires and a power supply.

Figure 2:
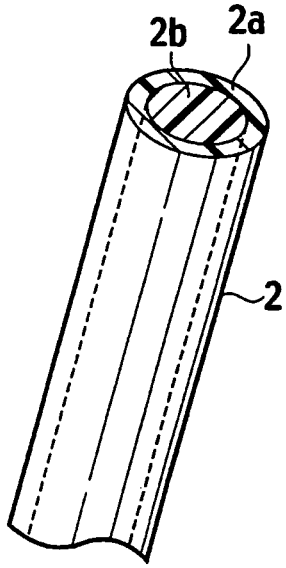
FIG. 2 is a schematic view showing a shape example of a core-sheath fiber.
Figure 3:
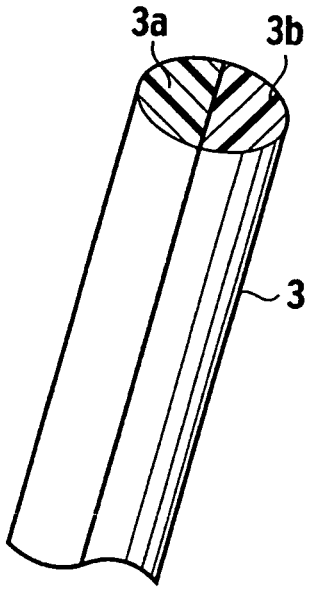
FIG. 3 is a schematic view showing a shape example of a side-by-side fiber.
Figure 4:
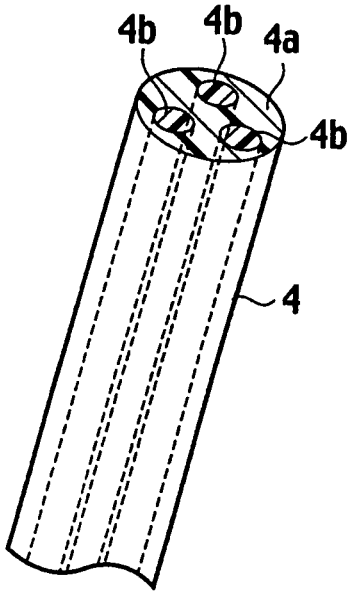
FIG. 4 is a schematic view showing a shape example of a sea-island fiber.
Figure 5:
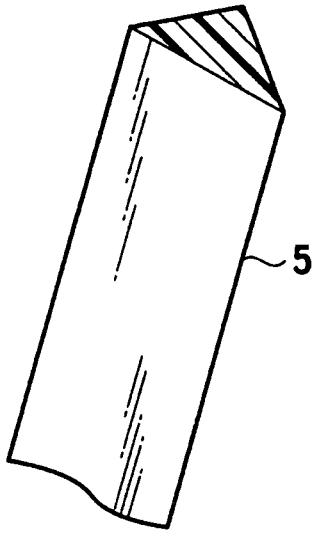
FIG. 5 is a schematic view showing a shape example on odd (triangle)-cross-section fiber.
Figure 6:
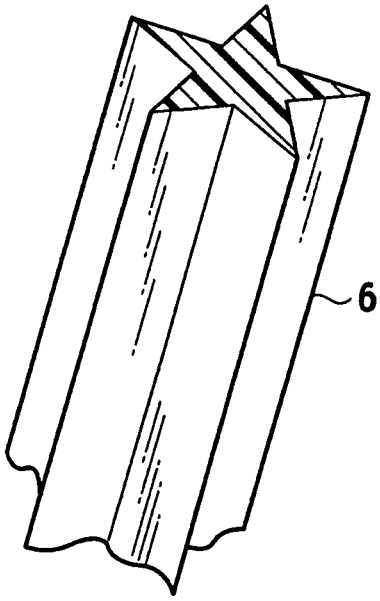
FIG. 6 is a schematic view showing a shape example of an odd (star)-cross-section fiber.
Figure 7:
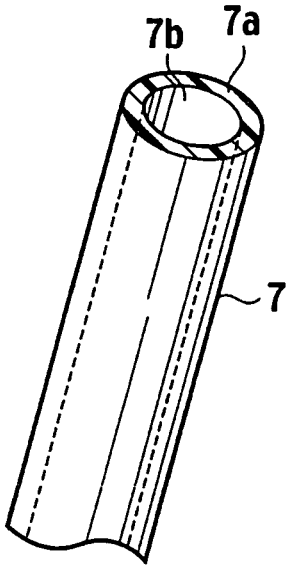
FIG. 7 is a schematic view showing a shape example of a hollow fiber.

Here, as general fibers, there are: a fiber 1 made of a uniform material, which is as shown in FIG. 1; a fiber 2 with a core-sheath structure when viewed on a cross section thereof, which is as shown in FIG. 2; a fiber 3 with a side-by-side structure, which is as show in FIG. 3; a fiber 4 with a sea-island (multicore) structure, which is as shown in FIG. 4; fibers 5 and 6 with deformed cross-sectional shapes in which cross sections are not circular as shown in FIGS. 5 and 6; a fiber 7 with a hollow structure, which is as shown in FIG. 7; and the like. Here, in FIG. 2, reference numeral 2*a* denotes a sheath component of the core-sheath fiber, and reference numeral 2*b* denotes a core component of the core-sheath fiber. In FIG. 3, reference numeral 3*a* denotes one component of the side-by-side fiber, and reference numeral 3*b* denotes a component composed of a material different from the one component 3*a* of the side-by-side fiber. In FIG. 4, reference numeral 4*a* denotes a sea component of the sea-island fiber, and reference numeral 4*b* denotes island components of the sea-island fiber. In FIG. 7, reference numeral 7*a* denotes a fiber component of the hollow fiber, and reference numeral 7*b* denotes a hollow of the hollow fiber. As one of means for functionalizing the fiber, such a structure is used in the case of changing a feeling of a fabric made of the fiber as a result of natural twist of the fiber itself, in the case of aiming weight reduction/heat insulating properties by enlarging a surface area of the fiber, and so on.

A purpose intended by the present invention is not to make contrivance for changing static characteristics of these fibers, but to control the air permeability of cloth or a sound absorbing material by allowing these fibers to develop dynamic functions such as actuation in the case of forming these fibers into the cloth or the sound absorbing material. Hence, another material is stacked on the surface of the electrical-conductive polymer in order to deform the fiber in a desired direction, thus making it possible to control such a deformation direction. This is because a surface in which a motion is inhibited occurs, whereby the fiber is bent in a predetermined direction or crimped in the case of viewing a fiber shape macroscopically.

The fiber in the present invention refers to one having a thickness to an extent used generally for a fiber product, that is, having a diameter ranging from 1 to 500 μm. A fiber having such a deformation function though having a diameter extending for several millimeters is also seen. However, in the case of using such a fiber, it is difficult to obtain the cloth of a knit, a fabric, a non-woven fabric or the like, in which the quantity of airflow is variable. The composite fiber in the present invention can impart the actuation function even to the cloth of the knit, the fabric, the non-woven fabric or the like, to which it has been heretofore difficult to impart the actuation function.

Figure 8:
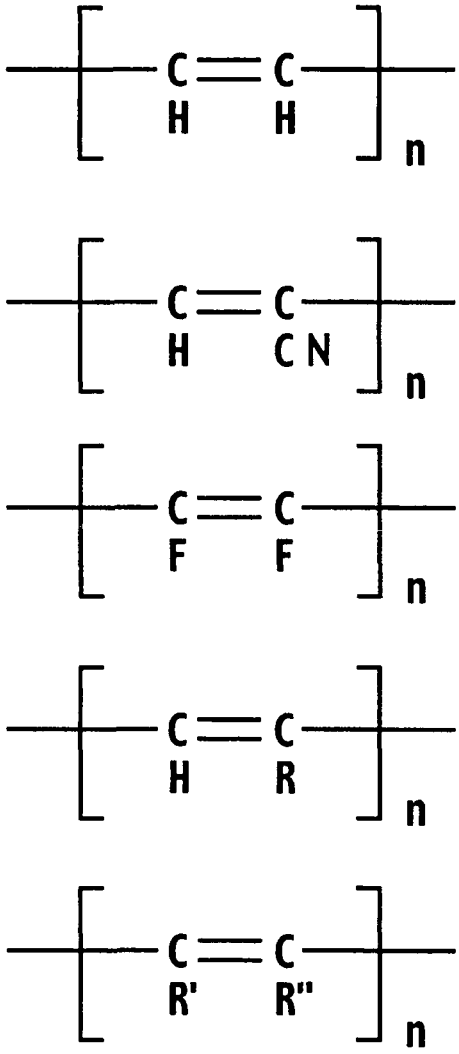
FIG. 8 is examples of chemical formulae of acetylene electrical-conductive polymers.
Figure 9:
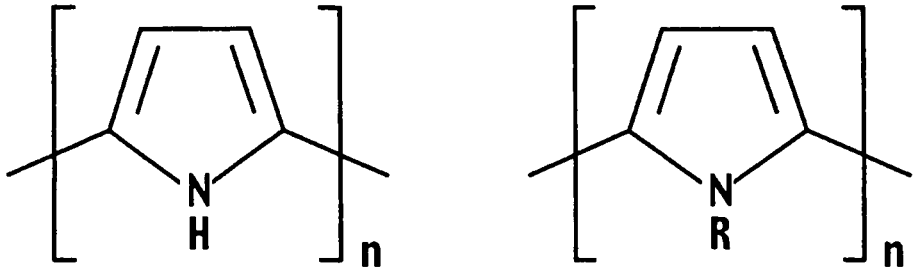
FIG. 9 is examples of chemical formulae of pyrrole electrical-conductive polymers.
Figure 10:
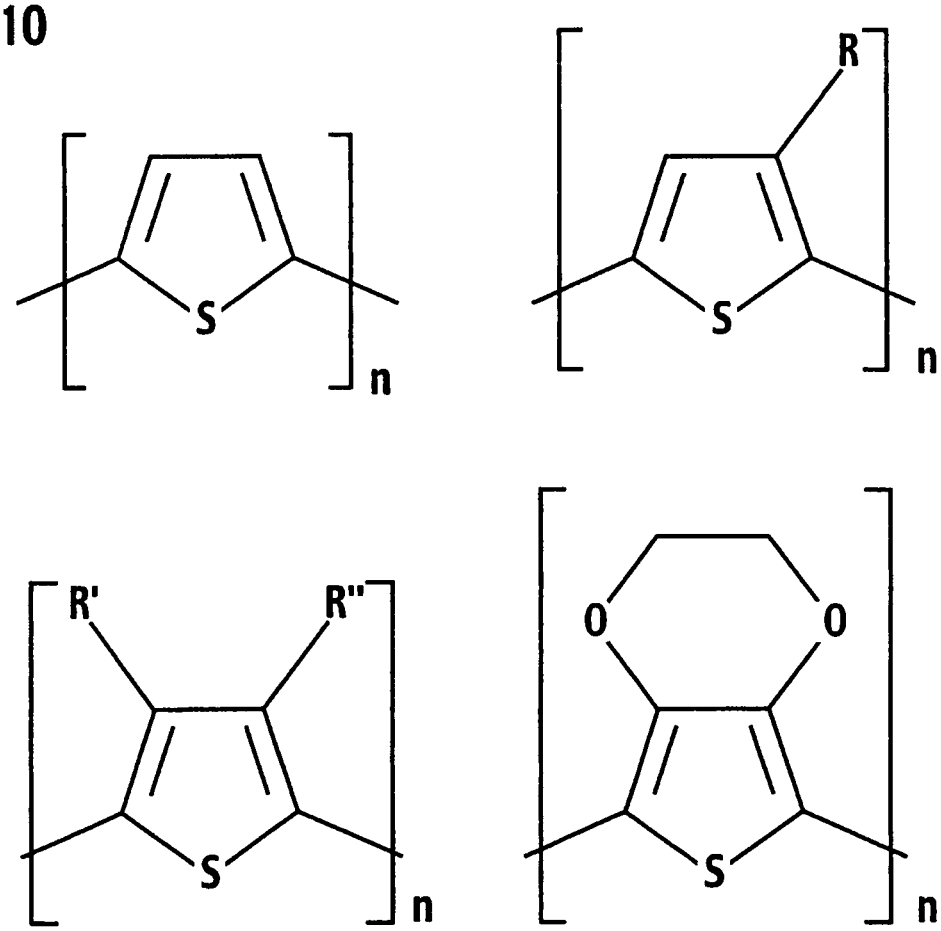
FIG. 10 is examples of chemical formulae of thiophene electrical-conductive polymers.
Figure 11:
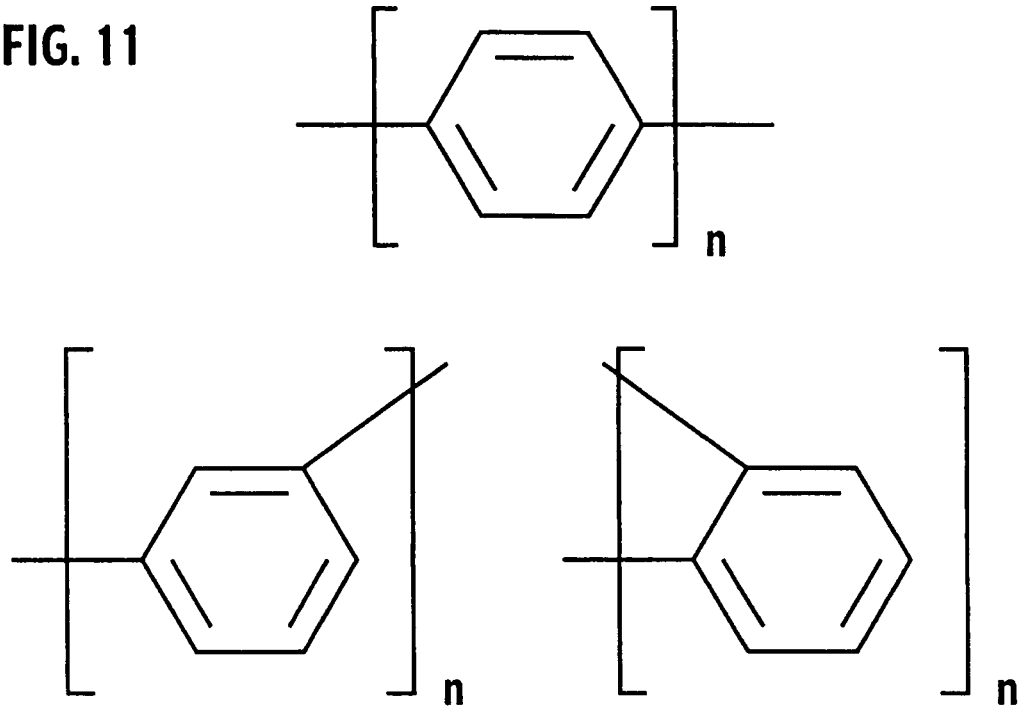
FIG. 11 is examples of chemical formulae of phenylene electrical-conductive polymers.
Figure 12:
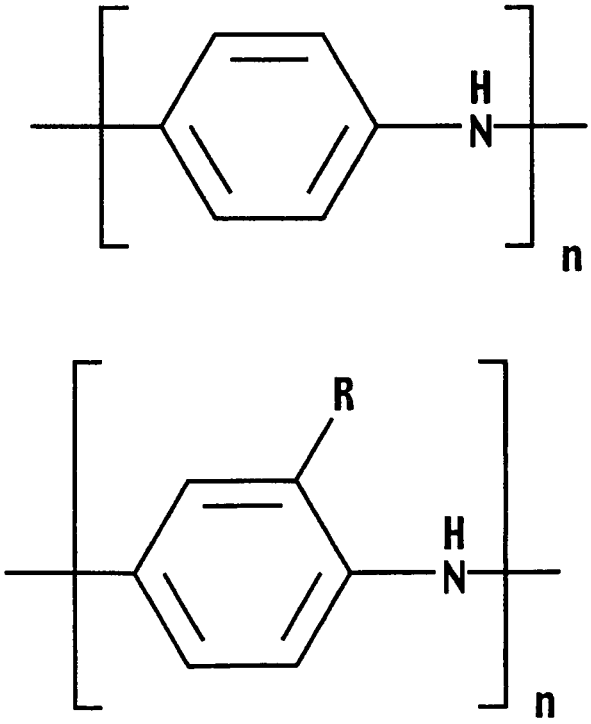
FIG. 12 is examples of chemical formulae of aniline electrical-conductive polymers.

The electrical-conductive polymer for use in the present invention is not particularly limited as long as it is a polymer exhibiting electrical-conductivity. As the electrical-conductive polymer, there are mentioned: acetylene electrical-conductive polymers; heterocyclic-five-membered-ring electrical-conductive polymers (pyrrole polymers obtained by polymerizing, as monomers: 3-alkylpyrrole such as 3-methylpyrrole, 3-ethylpyrrole and 3-dodecylpyrrole; 3,4-dialkylpyrrole such as 3,4-dimethylpyrrole and 3-methyl-4-dodecylpyrrole; N-alkylpyrrole such as N-methylpyrrole and N-dodecylpyrrole; N-alkyl-3-alkylpyrrole such as N-methyl-3-methylpyrrole and N-ethyl-3-dodecylpyrrole; 3-carboxypyrrole; and the like; as well as pyrrole, thiophene polymers, isothianaphthene polymers, and the like); phenylene electrical-conductive polymers; aniline electrical-conductive polymers; copolymers of these; and the like (FIG. 8: the acetylene electrical-conductive polymers; FIG. 9: the pyrrole electrical-conductive polymers; FIG. 10: the thiophene electrical-conductive polymers; FIG. 11: the phenylene electrical-conductive polymers; and FIG. 12; the aniline electrical-conductive polymers). Among them, as materials easy to obtain as the fiber, there are mentioned: PEDOT/PSS (Baytron P (registered trademark), made by Bayer AG) in which poly-4-styrenesulfonate (PSS) is doped into poly-3,4-ethylenedioxythiophene (PEDOT) as a thiophene electrical-conductive polymer; phenylene polyparaphenylene vinylene (PPV); and the like.

Moreover, in the electrical-conductive polymer, a dopant brings up a dramatic effect to the conductivity thereof. As the dopant used herein, there can be used at least one type of ions among polymer ions such as: halide ions such as chloride ions and bromide ions; perchlorate ions; tetrafluoroborate ions; hexafluoroarsenate ions; sulfate ions; nitrate ions; thiocyanate ions; hexafluorosilicate ions; phosphoric ions such as phosphate ions, phenylphosphate ions and hexafluorophosphate ions; trifluoroacetate ions; alkylbenzenesulfonate ions such as tosylate ions, ethylbenzenesulfonate ions and dodecylbenzenesulfonate ions; alkylsulfonate ions such as methylsulfonate ions and ethylsulfonate ions; polymer ions such as polyacrylate ions, polyvinylsulfonate ions, polystyrenesulfonate ions and poly(2-acrylamide-2-methylpropanesulfonate) ions. Loadings of the dopant are not particularly limited as long as the dopant can impart the effect to the conductivity; however, in usual, the loadings of the dopant are within a range of 3 to 50 parts by mass, preferably 10 to 30 parts by mass, with respect to 100 parts by mass of the electrical-conductive polymer.

As a type of the above-described composite fiber, for example, one with a stack structure and one with a penetration structure are mentioned. The stack structure refers to a structure in which a material different from the electrical-conductive polymeric material composing the fiber is stacked on a part of the surface of the electrical-conductive polymeric material. Here, the "surface" refers to an outer circumference of a cross section of the fiber, which is cut perpendicularly to the longitudinal direction of the fiber. Moreover, "a part of the surface" refers to a part of the outer circumference, in which the part continues from one end of the fiber to the other end thereof continuously or intermittently. For example, "a part of the surface" represents a state where such another material that forms a stacked object by being stacked on a surface of the fibrous object containing the electrical-conductive polymer as a core does not uniformly cover the entire surface along the outer circumference of the electrical-conductive polymer and the like.

The material different from the electrical-conductive polymeric material is not particularly limited as long as it differs from the electrical-conductive polymeric material; however, the different material is a resin material for forming resin, and preferably, thermoplastic resin. The reason for this is as follows. The electrical-conductive polymeric material is mainly used as an electrical-conductive component, and accordingly, is combined with a material with more similar properties, thus making it possible to obtain a fiber shape while preventing the motion of the electrical-conductive polymer from being inhibited as much as possible. Moreover, the thermoplastic resin is used as the different material, whereby the stacked object can be molded into a desired shape in the case of thereafter being used as a product. As specific examples, there can also be used: polyamide such as Nylon 6 and Nylon 66; polyethylene terephthalate; polyethylene terephthalate containing a copolymer component; polybutylene terephthalate; polyacrylonitrile; an acrylic emulsion; a polyester emulsion; and the like. These resins can be used singly or by being mixed with the others.

Figure 13:
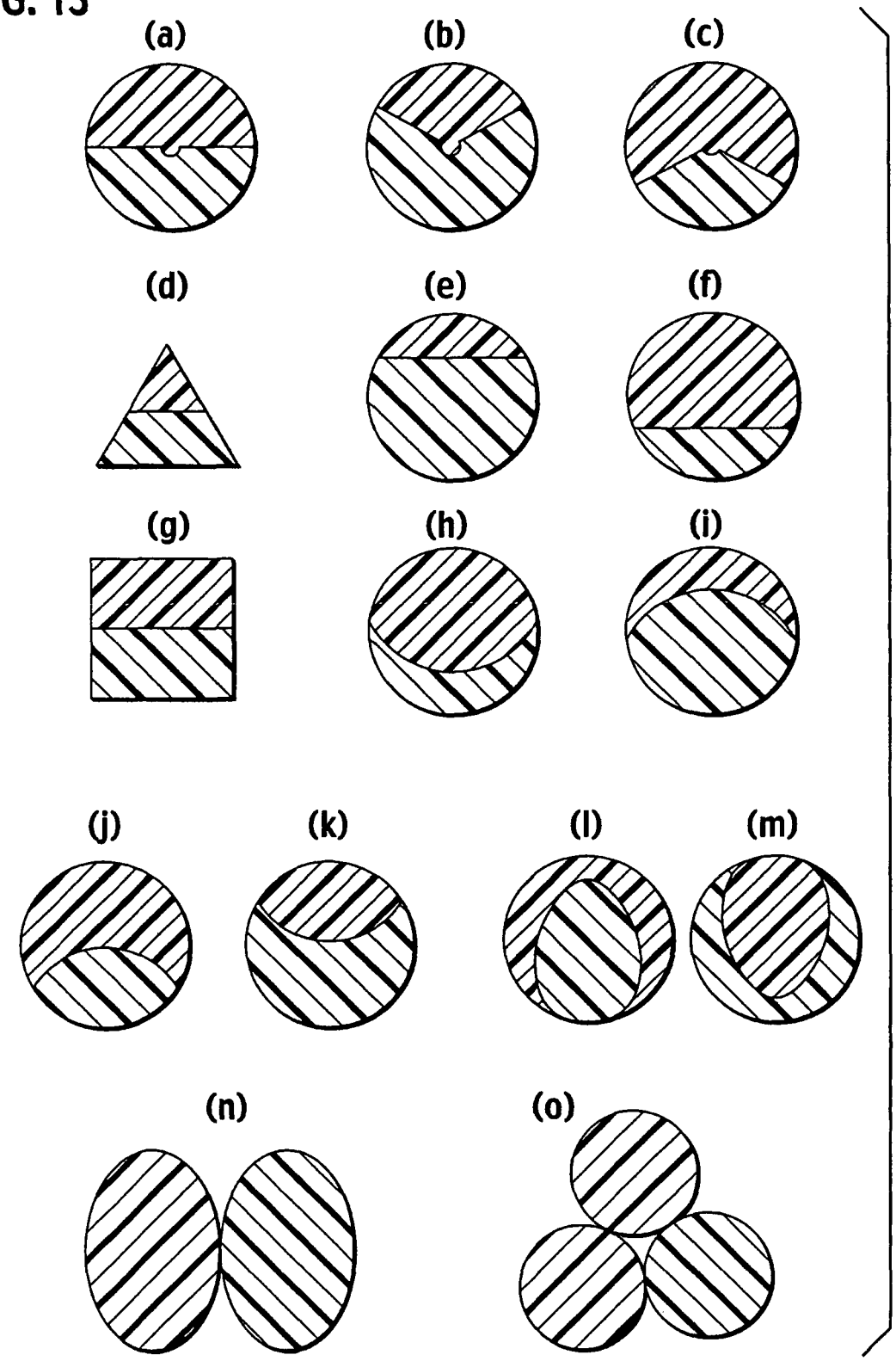
FIG. 13 is schematic cross-sectional views showing cross-sectional shapes of composite fibers according to the present invention, in each of which a part of a surface layer is formed of a different material.

In the stack structure, for the cross-sectional shape of the fiber, which is perpendicular to the longitudinal direction thereof, as shown in FIG. 13, there can be employed: circular shapes ((a), (b), (c), (e), (f), (h), (i) to (m) in FIG. 13); and as odd cross-sectional shapes besides the circular shapes, a flat shape; a hollow shape; a triangular shape ((d) in FIG. 13); a square shape ((g) in FIG. 13); a Y-shape; a shape in which a plurality of ellipsoidal fibers are adhered to each other ((n) in FIG. 13); a shape in which a plurality of circular fibers are adhered to one another ((o) in FIG. 13); a fiber form in which fine irregularities and streaks are provided on a surface of a fiber; and the like. Moreover, the cross section of the electrical-conductive polymer or the material different from the electrical-conductive polymeric material is formed into a shape such as a semicircle ((a) in FIG. 13), fans ((b), (c), (j), (k) in FIG. 13), shapes leaning to an upper portion or lower portion of a fiber ((e), (f) in FIG. 13), crescents ((h), (i) in FIG. 13), and eggs ((l), (m) in FIG. 13). In such a way, in the case of energizing the electrical-conductive polymer as the electrical-conductive component and the like, the electrical-conductive polymer shrinks. Accordingly, the electrical-conductive polymer causes a length difference from the other material stacked on the surface of the fiber, whereby, in the case of viewing the fiber macroscopically, a behavior (actuation) in which the fiber is bent in a predetermined direction, that is, a behavior in which the fiber is bent on a plane will be exhibited. When such a motion is increased, the fiber will exhibit a behavior of the crimp. In each of the cross-sectional shapes shown in FIG. 13, it is represented by different hatchings that the materials are different from each other. In the drawings showing the cross sections in this application, the case where the hatchings are the same stands for that the materials are the same.

In the present invention, regardless of sizes of the material areas, the functions of each fiber can be developed if the above-described two types of materials are combined together. In such a cross section, a ratio of an area where an electrical-conductive drive layer is formed and an area where a restraint layer restraining drive force is not particularly limited as long as the behavior in which the fiber is bent in the predetermined direction is exhibited. However, the ratio is usually within a range of 1:10 to 10:1, preferably within a range of 1:3 to 3:1. The ratio is set within this range, whereby the composite fiber of the present invention can exhibit the behavior to bend in the predetermined direction. Here, the drive layer stands for a layer composed of the electrical-conductive polymeric material, and the restraint layer stands for a layer composed of the material different from the electrical-conductive polymeric material.

Moreover, for the stack structure, a side-by-side type is preferably used. Here, the side-by-side refers to one in which, in the cross-sectional shape, the area where the electrical-conductive drive layer is formed and the area where the restraint layer restraining the drive force is approximately 1:1. However, from a viewpoint of obtaining the function, the area just needs to range from 1:10 to 10:1, preferably from 1:3 to 3:1 in a similar way to the above. The area ratio is set as described above, whereby not only the actuation function can be obtained but also strength of the composite fiber itself imparted with this function can be enhanced.

Moreover, as a contrivance for setting a longitudinal extension/contraction amount of the fiber at a predetermined amount, the resin material may be disposed in a split manner in the longitudinal direction of the fiber composed of the electrical-conductive polymer. In such a way, fine adjustment of a longitudinal crimp amount of the fiber is also facilitated. For example, in the case where the restraint layer is assumed to continue from one end thereof to the other end, and a volume thereof from the one end to the other end is defined as 100 parts by volume, then a ratio of the restraint layer should be usually set within a range of 10 parts by volume or more, preferably within a range of 30 parts by volume or more.

A description will be made below of a production method of the composite fiber of the stack type based on the drawings.

The composite fiber of the stack structure type can be produced in such a manner that the material (resin material and the like) different from the material of the core portion obtained by a method such as wet spinning and electric field polymerization is stacked as a stack component on the fiber of the electrical-conductive polymer, which becomes the core portion, in a continuous process.

Figure 14:
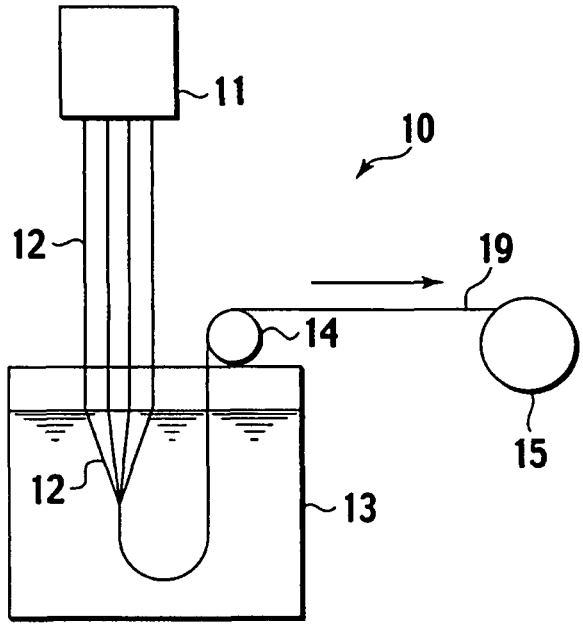
FIG. 14 is a schematic view of a wet spinning machine according to the present invention.

For example, the thiophene material as the electrical-conductive polymer can be produced by the wet spinning. FIG. 14 is a schematic view of a wet spinning machine for use in the present invention. In the wet spinning machine 10 shown in FIG. 14, for example, a water dispersion (Baytron P (registered trademark)) of PEDOT/PSS is extruded from a wet spinning mouthpiece 11, and an extruded precursor 12 of the composite fiber is made to pass through a wet spinning solvent bath 13 that contains a solvent such as acetone. After being made to pass through the solvent bath 13, the precursor 12 passes through a fiber feeder 14, followed by drying. Then, the precursor 12 is spooled by a fiber spool 15, whereby a composite fiber 19 containing the electrical-conductive polymer is obtained.

Figure 15:
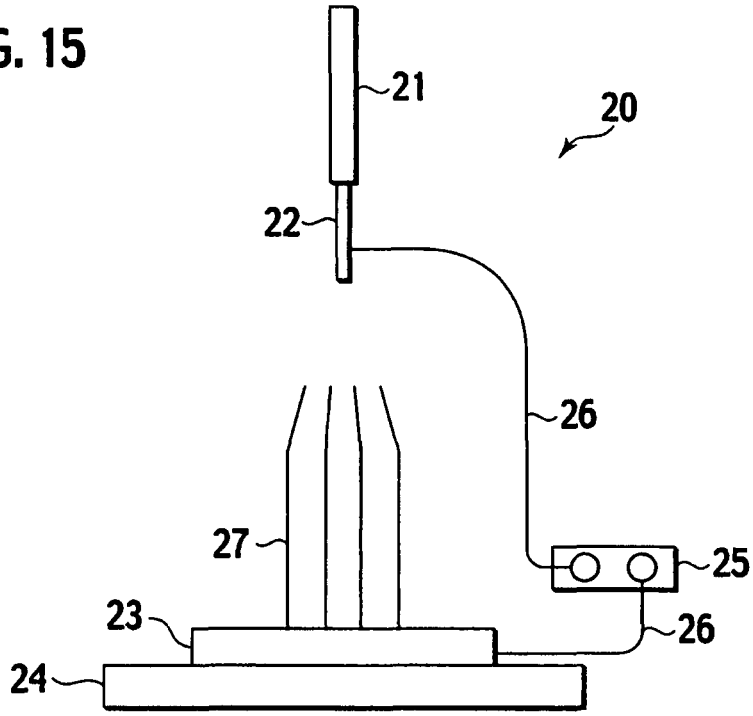
FIG. 15 is a schematic view of an electrospinning machine according to the present invention.

Meanwhile, the phenylene materials such as the polyparaphenylene, the polyparaphenylene vinylene and polyfluorene are of a type that makes electric conduction by using π bond on a benzene ring and π bond on a straight chain connected thereto. Therefore, it is possible to form these electrical-conductive polymers into fibers by an electrospinning method. FIG. 15 is a schematic view of an electrospinning machine according to the present invention. In the electrospinning machine 20 shown in FIG. 15, a voltage application device 25 is provided between a needle tip of a cylinder needle 22 of a cylinder 21 and an electrode 23 mounted on an insulating material (base) 24 placed below the cylinder 21 while individually interposing electric wires 26 therebetween. For example, first, the phenylene material such as the polyparaphenylene and alcohol such as methanol are mixed together, whereby a spinning raw liquid is prepared. Then, the prepared raw liquid is extruded from the needle tip of the cylinder needle 22 of the cylinder 21 toward the electrode 23 while applying a voltage thereto. By this method, precursor fibers 27 of the composite fiber are deposited on the electrode 23. The obtained precursor fibers are dried by a publicly known method such as vacuum drying, whereby the fibers are obtained.

By such fiber production processes as described above, the fibers serving as drive sources for use in the composite fiber of the stack structure type can be produced.

The material (resin material and the like) different from the material of the fiber can be continuously stacked on the surface of the obtained fiber of the electrical-conductive polymer by a method such as application and coating. Such an application or coating method of the fiber will be described by using the drawings.

Figure 16:
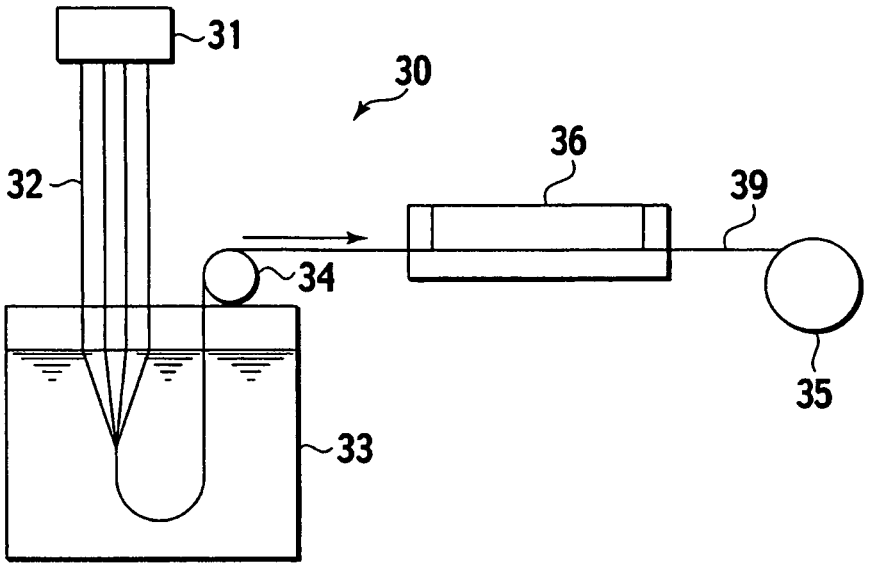
FIG. 16 is a schematic view of an apparatus in which an application step is provided in the wet spinning machine according to the present invention.

FIG. 16 is a schematic view of an apparatus in which the application step is provided in the wet spinning machine according to the present invention. In the wet spinning machine 30 shown in FIG. 16, the spinning raw liquid of the electrical-conductive polymer is extruded from a wet spinning mouthpiece 31, and an extruded precursor 32 of the composite fiber is made to pass through a wet spinning solvent bath 33 that contains a solvent such as acetone. After passing through the solvent bath 33, the precursor 32 passes through a fiber feeder 34, and is applied with the resin material and the like and dried by an application/coating device 36. Thereafter, a composite fiber 39 is obtained, and is spooled by a fiber spool 35.

Figure 17:
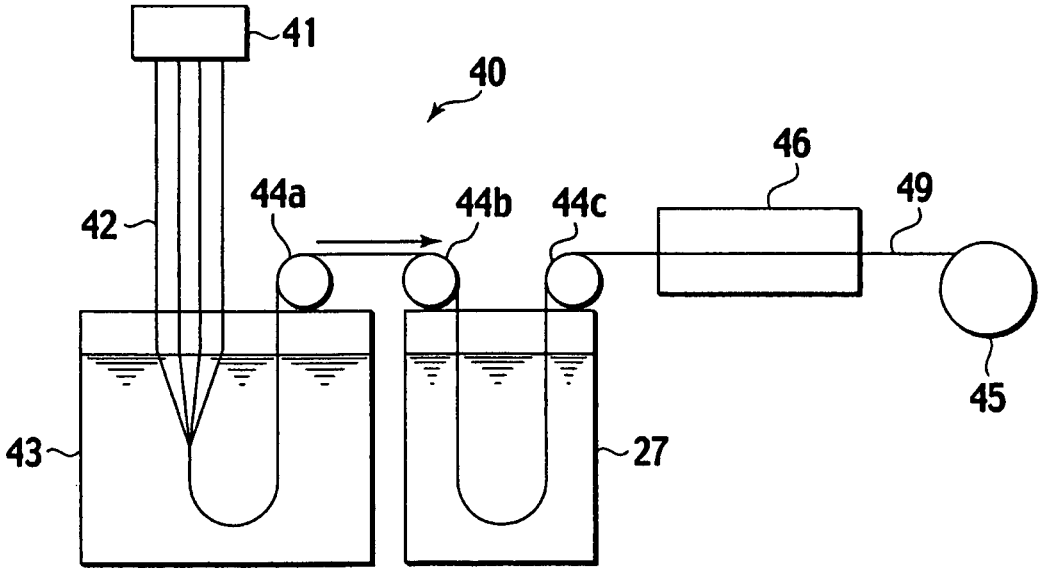
FIG. 17 is a schematic view of an apparatus in which a coating step is provided in the wet spinning machine according to the present invention.

FIG. 17 is a schematic view of an apparatus in which the coating step is provided in the wet spinning machine according to the present invention. In the wet spinning machine 40 shown in FIG. 17, the spinning raw liquid of the electrical-conductive polymer is extruded from a wet spinning mouthpiece 41, and a precursor 42 of the composite fiber is made to pass through a wet spinning solvent bath 43 that contains a solvent such as acetone. After passing through the solvent bath 43, the precursor 42 passes through fiber feeders 44*a* and 44*b*, and is fed to a coating bath 47 in which the polyester emulsion and the like are contained. The fiber into which the emulsion is immersed is fed to a drying device 46 by a fiber feeder 44*c*, and is dried there. Thereafter, a composite fiber 49 is obtained, and is spooled by a fiber spool 45.

It is possible to adjust an amount of the resin remaining on the surface by adjusting time and temperature of the drying step. Accordingly, those having different cross-sectional shapes can be obtained depending on various drying conditions.

Moreover, with regard to a method of disposing the resin material in a split manner in the longitudinal direction of the composite fiber, the composite fiber can be obtained by applying a volatile solution containing the resin material intermittently on the surface of the fiber.

<Composite Fiber with Penetration Structure>

Meanwhile, besides the stack structure, a structure is adopted, in which a part of the cross section of the fiber, which is perpendicular to the longitudinal direction thereof, allows penetration of the material different from the electrical-conductive polymer. Also in such a way, it is possible to obtain the composite fiber. Note that, in usual, the "penetration" refers to an action to penetrate a material from one end to the other end. However, in the present invention, the following case is also incorporated in the "penetration". Specifically, even if the material to be penetrated is split, in the case where such a different material is added to a split spot, such a case can be regarded to have a penetration structure.

Figure 18:
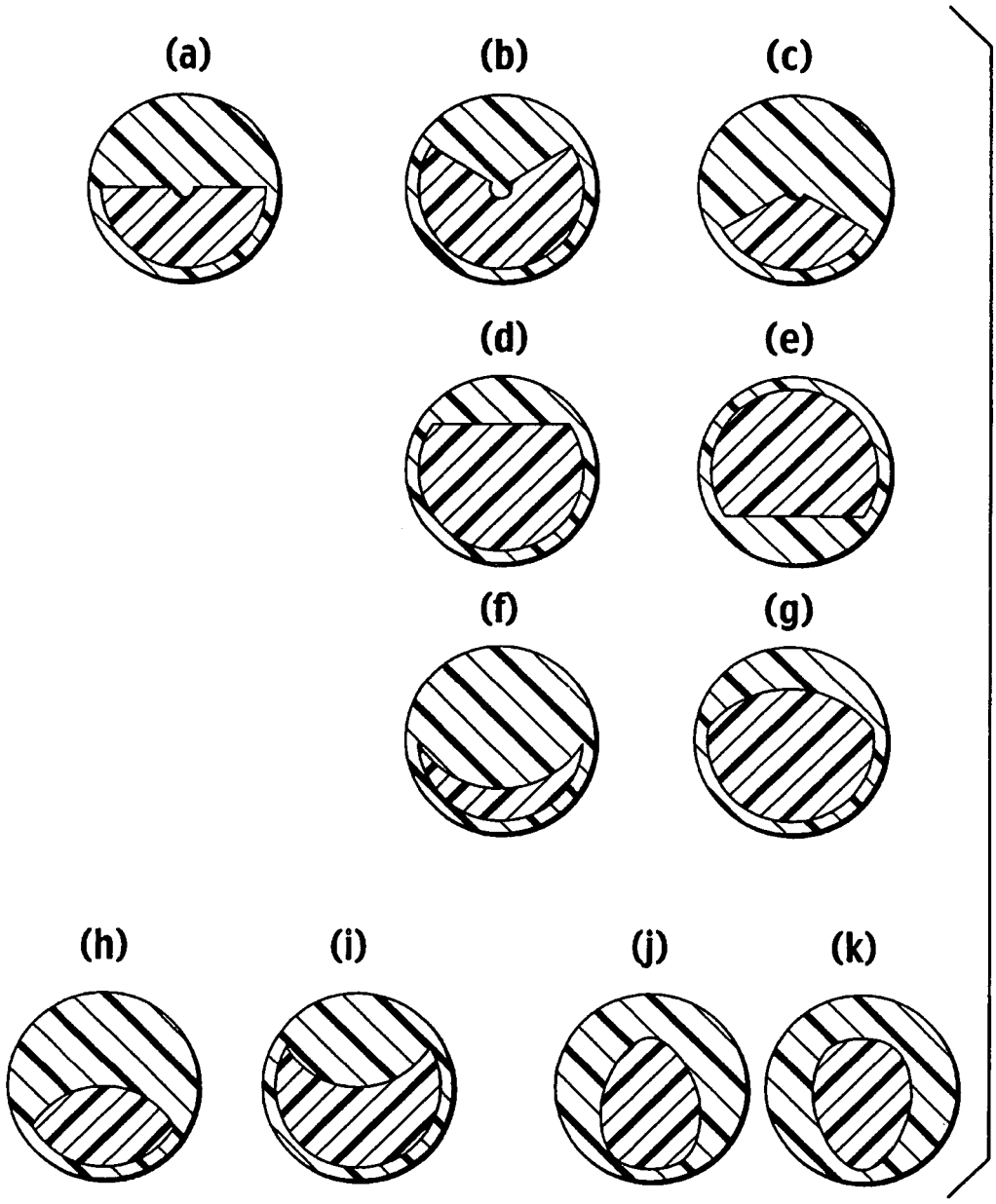
FIG. 18 is schematic cross-sectional views showing cross-sectional shapes of composite fibers according to the present invention, in each of which a part of a cross section is formed of a different material.
Figure 19:
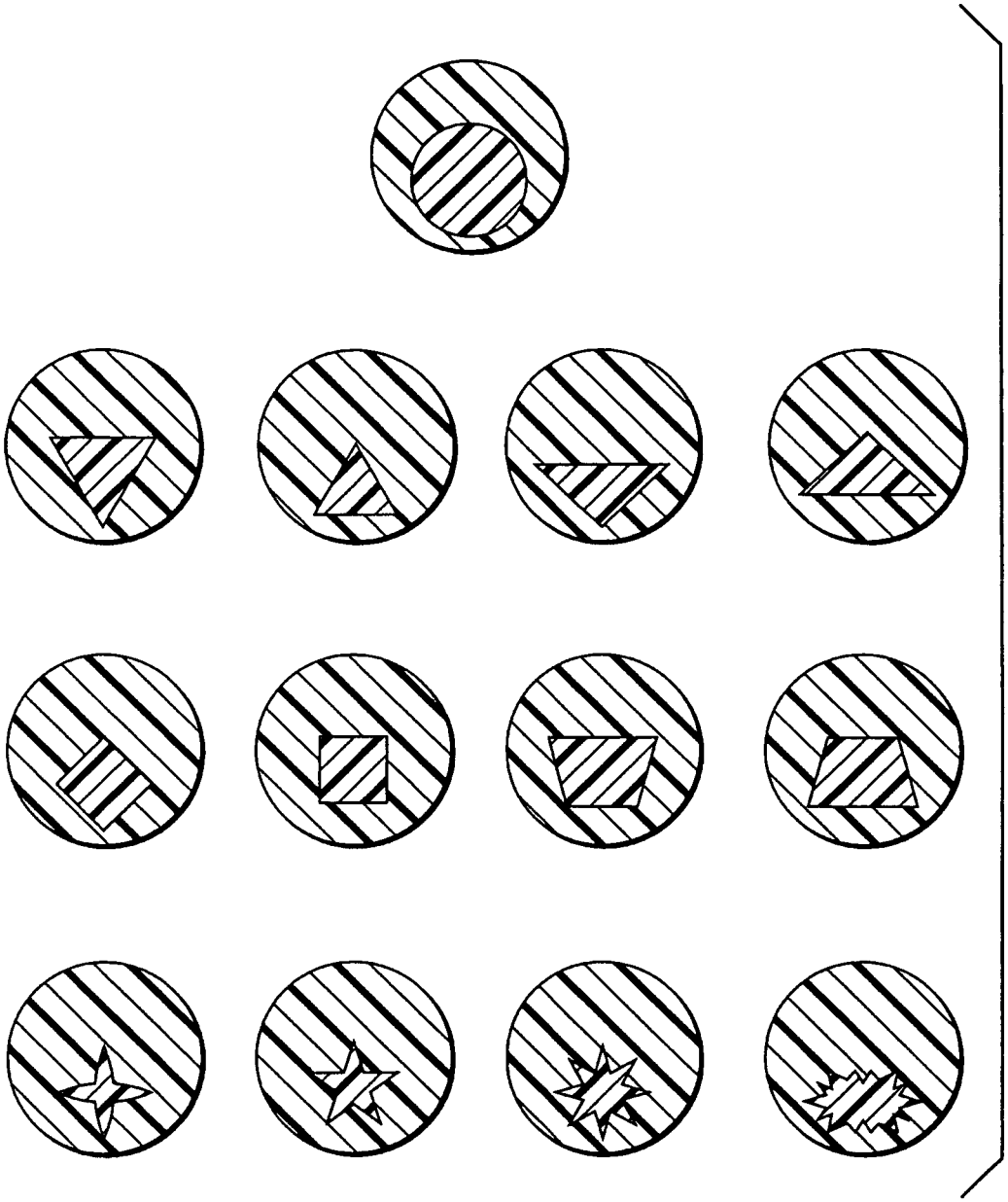
FIG. 19 is schematic cross-sectional views showing cross-sectional shapes of composite fibers according to the present invention, in each of which a part of a cross section is formed of a different material.
Figure 20:
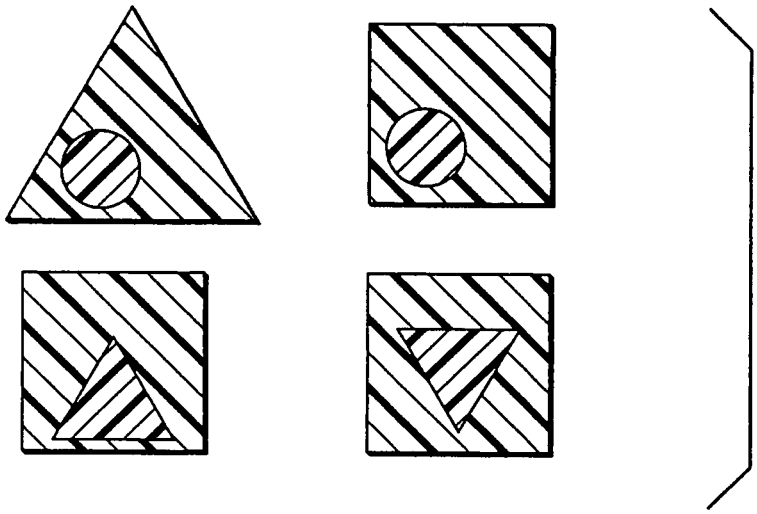
FIG. 20 is schematic cross-sectional views showing cross-sectional shapes of composite fibers according to the present invention, in each of which a part of a cross section is formed of a different material.

As a material composing a part of the above-described cross section, the resin material is preferably used, and the thermoplastic resin is more preferably used. Here, as shown in FIG. 18 to FIG. 20, in the case of viewing the cross section of the fiber, the structure in which a part of the cross section is penetrated represents a shape in which either of the material serving as a drive portion and the material that does not drive occupies the entire outer circumference of the cross section, and represents a state where the component that does not occupy the outer circumference is included in the core portion of the cross section. By adopting this shape, in the case of using the electrical-conductive component for the core portion, durability of the surface of the fiber itself will depend on the other material. Then, in the case of using the resin material, the durability of the surface of the fiber itself is generally enhanced. Moreover, in particular, in the case of using the electrical-conductive component for the sheath portion, an electrical-conductive portion will appear on the surface. Accordingly, in the case of using the fiber while making the electric conduction therethrough, the fiber can be obtained in a state where it is easy to obtain contact with a contact point.

Note that, for the electrical-conductive polymer, the resin material and the thermoplastic resin, the same materials as the materials used for the stack structure can be used.

In the penetration structure, for the cross-sectional shape of the fiber, which is perpendicular to the longitudinal direction thereof, for example, there can be employed: circular shapes as shown in FIG. 18; and as odd cross-sectional shapes besides the circular shapes, fiber forms such as a flat shape, a hollow shape, a triangular shape and a Y-shape; fiber forms such as a shape in which fine irregularities and streaks are provided on a surface of a fiber; and the like. Moreover, the cross section of the electrical-conductive polymer or the material different from the electrical-conductive polymeric material is formed into a shape such as a semicircle ((a) in FIG. 18), fans ((b), (c), (h), (i) in FIG. 18), shapes leaning to an upper portion or lower portion of a fiber ((d), (e) in FIG. 13), crescents ((f), (g) in FIG. 18), and eggs ((j), (k) in FIG. 13). In such a way, in the case of energizing the electrical-conductive polymer as the electrical-conductive component and the like, the electrical-conductive polymer shrinks. Accordingly, the electrical-conductive polymer causes a length difference from the material stacked on the entire surface of the fiber, whereby, in the case of viewing the fiber macroscopically, a behavior (actuation) in which the fiber is bent in a certain direction, that is, a behavior in which the fiber is bent on a plane will be exhibited. When such a motion is increased, the fiber will exhibit a behavior of the crimp.

In each of the cross-sectional shapes shown in FIG. 18, it is represented by different hatchings that the materials are different from each other. Moreover, regardless of sizes of the material areas, the functions of each fiber can be developed if the two types of materials are combined together.

Note that, in such a cross section, a ratio of an area where an electrical-conductive drive layer is formed and an area where a restraint layer restraining drive force is the same as in the case of the stack structure.

In particular, it is preferable that such a cross section be formed into a core-sheath type. Here, the core-sheath type refers to one in which an area ratio of a core portion and a sheath portion on the cross section is 1:1. From a viewpoint of obtaining the function, the area just needs to range from 1:10 to 10:1, preferably from 1:3 to 3:1 in a similar way to the above. With such a configuration, the function can be developed best in the case of considering a balance between the strength and drive of the fiber. The number of core portions is not limited to one, and the multicore (sea-island) structure may be employed. Moreover, the core portion is arranged so that a distance thereto from the center can be nonuniform, or is arranged eccentrically, whereby a similar effect is obtained.

Moreover, in the core-sheath type, eccentric types (FIGS. 19 to 20) are particularly preferable. In the case where the cross section of the core portion and the sheath portion is circular, in particular, the center of the core portion is shifted and decentered from the center of the fiber, whereby the behavior of the bending can be developed significantly.

Figure 21:
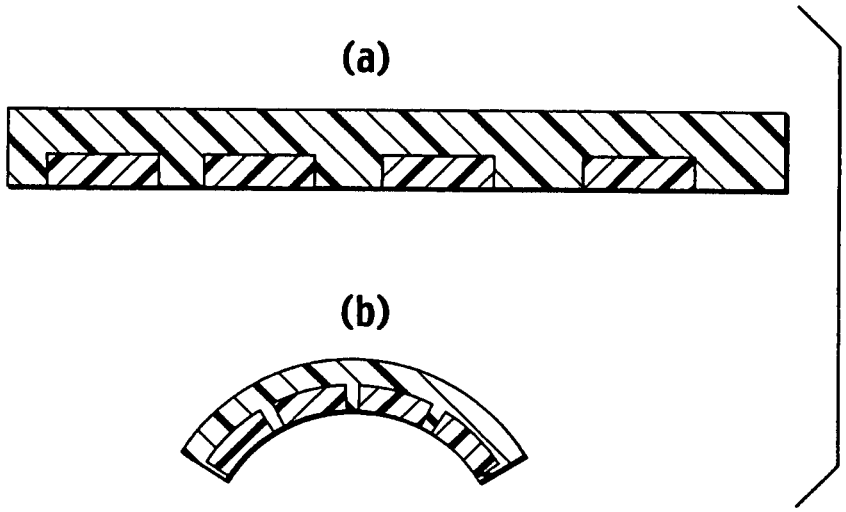
FIG. 21 is schematic side cross-sectional views of composite fibers according to the present invention, each of which includes a surface layer formed of a different material divided in a longitudinal direction.

Furthermore, as the contrivance for setting the crimp amount of the composite fiber at a desired amount, the resin material may be disposed in a split manner. (a) in FIG. 21 shows a state before the composite fiber is applied with the power supply, and (b) in FIG. 21 shows a state where the composite fiber is bent. In such a way, the fine adjustment of the crimp amount is also facilitated.

Next, a description will be made of a production method of the composite fiber with the core-sheath structure.

The composite fiber is produced by using a core-sheath type wet spinning machine publicly known in the fiber production industry. From a core portion of a mouthpiece, an acrylonitrile solution containing N,N-dimethylacetoamide or the like as a solvent is ejected. From a sheath portion of the mouthpiece, a material in which poly-4-styrenesulfonate is doped into poly-3,4-ethylenedioxythiophene, or the like is ejected. Both of the solution and the material are simultaneously ejected into a solvent such as N,N-dimethylacetoamide. The core-sheath fiber can be obtained by thereafter removing the solvent.

Moreover, with regard to another composite fiber, the ejection mouthpiece for the core-sheath type is used in the case of the wet spinning, thus making it possible to fabricate the composite fiber of the side-by-side type by one-time raising from a liquid phase.

Furthermore, with regard to the method of disposing the resin material in a split manner in the longitudinal direction of the composite fiber, the composite fiber can be obtained by repeating ejection-stop of the raw liquids in the stacked portion in the case of using the wet spinning machine of the core-sheath type.

<Fiber Bundle>

The fiber bundle for use in the present invention includes: the composite fibers having the structure in which the material different from the electrical-conductive polymeric material is stacked on a part of the surface layer of the electrical-conductive polymeric material; and according to needs, the crimped yarns composed of the material that does not contain the electrical-conductive polymer. A configuration in which the electrodes are attached to the fiber bundle is adopted, whereby a fiber bundle diameter is reversibly changed by the energization.

The composite fibers as constituents of the fiber bundle in the present invention are formed into a bundle including the crimped yarns therein, and are provided, as controlling means therefor, with the current applying means for flowing a current through the composite fibers, whereby the composite fibers themselves can make the motions, which are the crimp-extension, by the energization. Moreover, by using the motions and repulsive force of the crimped yarns, it becomes possible to reflect the motions on the change of the fiber diameter smoothly and accurately.

Note that the fiber bundle of the present invention is a bundle in which, for example, several ten to several thousands fibers, each having a certain diameter, are bundled. Moreover, the crimped yarns mentioned in the present invention refer to natural fibers and synthetic fibers, in which the crimp occurs naturally in a spinning process, or which are crimped by a machine after being spun. The crimp refers to a state where the yarns are crimped, and general fibers are bent at an interval from several hundred micrometers to several millimeters. As specific examples of the crimped yarns, there can be mentioned: polyamide such as Nylon 6 and Nylon 66; polyethylene terephthalate (PET); polyethylene terephthalate containing a copolymer component; polybutylene terephthalate; polyacrylonitrile; and the like. These resins can be used singly or by being mixed with the others.

In general, the repulsive force and resilience, which are inherent in the crimped yarns and are derived from the crimp, are used for imparting thickness to the cloth and the nonwoven fabric, and imparting a soft feeling thereto. However, in the present invention, the crimped yarns are combined with the composite fibers, whereby a configuration in which the fiber diameter of the fiber bundle can be controlled in a pseudo manner has been realized. Specifically, a configuration has been realized, in which the composite fibers are contained in the fiber bundle, whereby the crimped yarns can be bundled or loosened.

Such a pseudo change of the fiber diameter refers to a change between a state where friction between the fibers and the air is small and the air can flow through the fiber bundle and a state where the air cannot substantially flow through the fiber bundle since airflow resistance in the fiber bundle is increased extremely in the case of putting the configured fiber bundle into an airflow.

The former state is a state where, in terms of the fiber bundle, the surface of each of the fibers composing the fiber bundle is exposed independently though an apparent outer diameter of the bundle is increased. Accordingly, the former state is treated as: "the fiber diameter is thin in a pseudo manner" in the present invention. Meanwhile, in the latter state, in the case where the airflow resistance in the fiber bundle is large, the apparent outer diameter of the bundle is decreased; however, the bundle itself behaves substantially as one fiber, a surface area thereof is also derived from the outer diameter thereof, and the behavior thereof becomes equivalent to that of a bundle with a large fiber diameter. Accordingly, the latter state is treated as: "the fiber diameter is thick in a pseudo manner.

Next, with regard to a specific configuration of the fiber bundle in which the fiber bundle diameter is variable, it is preferable that the composite fibers for use in the fiber bundle be arranged along a surface layer side of the fiber bundle. The surface layer side of the fiber bundle, which is mentioned herein, refers to an outer circumferential side far from a center portion of cross section of the fiber bundle. By such arrangement of the composite fibers, the deformation of the composite fibers can be made to lead to the pseudo change of the fiber bundle diameter more efficiently. Moreover, the composite fibers are made to go along the surface layer of the fiber bundle, whereby the repulsive force of the crimped yarns can be suppressed by the deformation of the composite fibers.

Moreover, it is more preferable that the composite fibers for use in the variable-diameter fiber bundle be arranged in a spiral shape along the surface layer side of the fiber bundle. "Arranged in a spiral shape" mentioned herein refers to a state where the composite fibers are wound around the bundle of the crimped yarns in a twisted manner while making a certain angle therewith respect to a longitudinal direction thereof. This configuration makes it possible to increase the pseudo change of the diameter of the fiber bundle with the most efficiency, and can change the diameters of the fiber bundles having the several ten to several thousands fibers.

Although there are no particular limitations, in the case of winding the composite fibers in the spiral shape, the composite fibers are wound one time to a length in the longitudinal direction, which ranges, as a guideline, from 10 to 100 times the pseudo diameter. For example, in the case where the pseudo diameter is 150 μm, the composite fibers are wound one time to a length in the longitudinal direction of the fiber, which ranges from 1500 μm (1.5 mm) to 15000 μm (15 m).

Note that it is preferable that the composite fibers occupy an area of 0.1% or more to 50% or less with respect to a total cross-sectional area of the fibers composing the above-described fiber bundle. The reason for this is as follows. If the composite fibers are formed so as to occupy the entire cross-sectional area, then the composite fibers dynamically interfere with one another, and gaps among the composite fibers become less likely to be formed, and accordingly, there is an apprehension that the configuration of the fiber bundle may become one in which it is difficult to obtain the varying performance for the fiber diameter. Therefore, the area occupied by the composite fibers is set within the above-described range, thus making it possible to obtain more efficient varying performance.

In a similar way, it is also preferable that the composite fibers occupy an area of 0.1% or more to 50% or less with respect to a total surface area of the fiber bundle in the case where the composite fibers are arranged in the spiral shape along the surface layer side of the fiber bundle, and the diameter of the fiber bundle becomes the minimum. The reason for this is also as follows. In a similar way to the above-described configuration for the cross-sectional area, if the entire surface is formed of the composite fibers, then the composite fibers dynamically interfere with one another, and the gaps among the composite fibers become less likely to be formed, and accordingly, the configuration of the fiber bundle becomes one in which it is difficult to obtain the varying performance for the fiber diameter. Therefore, the area occupied by the composite fibers is set within the above-described range, thus making it possible to obtain the more efficient varying performance. In addition, the above-described setting of the area ratio can contribute to an increase of a difference in sound absorption coefficient between the case where the power supply is turned on and the case where the power supply is turned off.

Figure 30:
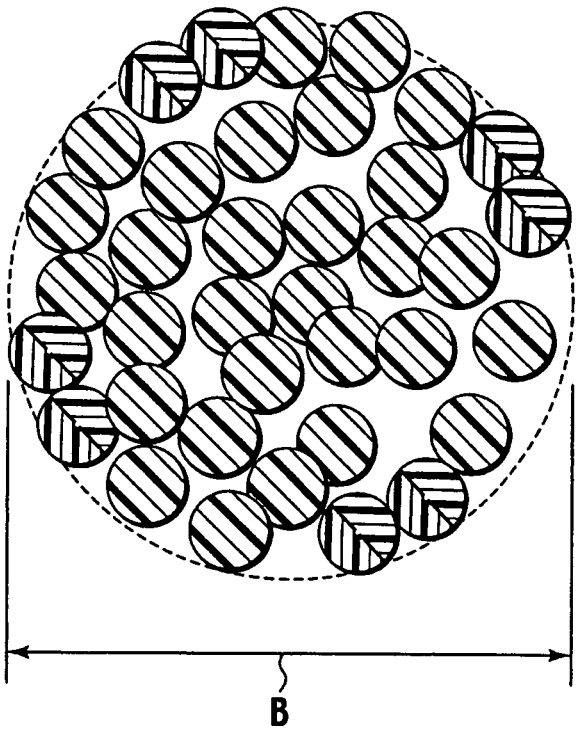
FIG. 30 is a schematic cross-sectional view along a line A-A' of FIG. 29.
Figure 32:
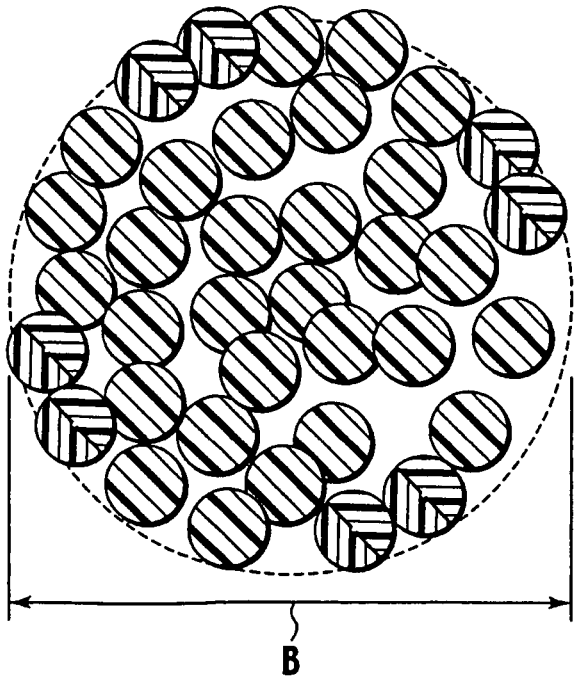
FIG. 32 is a schematic cross-sectional view along a line A-A' of FIG. 31.
Figure 33:
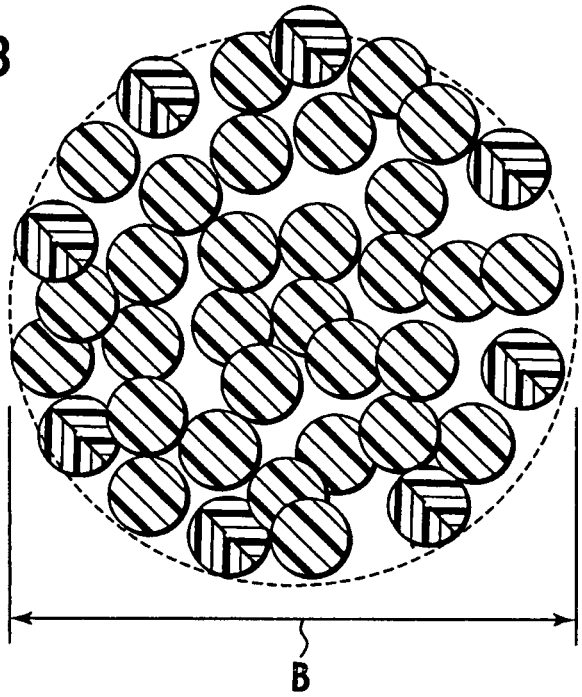
FIG. 33 is a schematic view showing a shape of Example II-6 of the present invention.

As shown in FIGS. 30, 32 and 33, it is also preferable that the composite fibers be arranged in the spiral shape along the surface layer side of the fiber bundle and in a divided manner with respect to the outer circumference of the fiber bundle in the case of being arranged on the outer circumference. By such arrangement in a split manner, the deformation of each of the composite fibers becomes freer, and the change of the diameter fiber can be increased. With regard to the divided number in this case, it is more preferable that the composite fibers be arranged in a divided manner on two to twenty spots on the outer circumference of the fiber bundle or in the vicinity of the outer circumference so that the spots can be opposite to one another while interposing a center point of the cross section of the fiber bundle. Moreover, in this case, the composite fibers may be arranged so as to divide the surface of the fiber bundle into two to twenty equal parts on the outer circumference of the fiber bundle. Furthermore, on the outer circumference of the fiber bundle, the composite fibers may be arranged in a divided manner on diagonal lines of the cross section of the fiber bundle.

It is desirable that the composite fibers occupy an area of 0.1% or more to 20% or less with respect to the total cross-sectional area of the fibers composing the above-described fiber bundle. Moreover, when the diameter of the above-described fiber bundle becomes the minimum, it is preferable that the composite fibers occupy an area of 5% or more to 50% or less with respect to the above-described total cross-sectional area.

Moreover, it is also preferable that the fiber bundle be composed by bundling, as a twisted yarn, the composite fibers and the crimped yarns. By twisting these yarns, the strength is increased as a fiber. In addition, by twisting these yarns, the deformation direction of the composite fibers becomes likely is oriented with ease, and accordingly, the pseudo fiber diameter can be controlled more accurately.

In order to obtain a larger difference of the quantity of airflow, only the above-described composite fibers may be used by being bundled as an aggregate like the above-described fiber bundle, or may be used by being bundled as the twisted yarn. The fiber bundle of the composite fibers can use the change of the fiber diameter for a device controlling a fluid, a device presenting a touch feeling, and the like. In the case of using the fiber bundle as such a control device for the fluid, this fiber bundle is disposed in a rubber-made tube, and the fiber bundle is energized while flowing therethrough a fluid having no conductivity, whereby a tube diameter can be changed, and a flow rate and pressure of the fluid can be changed. Meanwhile, in the case of using the fiber bundle as such a touch feeling presentation device, the fiber diameter is changed in the device, whereby a change of the touch feeling can be brought. The fiber bundle is directly disposed on a surface (surface touch by a person) of the device, whereby this effect can be sensed to a larger extent.

<Cloth>

Moreover, in the present invention, the cloth is fabricated by using the above-described composite fibers.

The cloth can be obtained by knitting and weaving the above-described composite fibers. In this case, in order to obtain a larger difference of the quantity of airflow, it is preferable that the composite fibers be used by being formed into an aggregate of the fiber bundles or by being bundled as the twisted yarns. Here, the cloth can be obtained by knitting and weaving the composite fibers by using publicly known methods.

Moreover, since the non-woven fabric has many entanglings of fibers, a space formed therein is increased in the case of forming the cloth therefrom, and accordingly, the non-woven fabric composed of the composite fibers can change the quantity of airflow to a large extent. Furthermore, in the case of the non-woven fabric, it is preferable to use the composite fibers by 100%; however, commingled and blended yarns with chemical fibers and natural fibers may be used.

In the case of fabricating the non-woven fabric, constituent fibers such as the chemical fibers, the natural fibers and binder fibers as well as the composite fibers are used by being cut into an average cut length ranging from 20 to 100 mm. First, these fibers are collected by a carding method or an airlaid method, and a web is formed. Subsequently, the web is compressed, and is heated at a temperature that is equal to or higher than a softening point of the binder fiber, at which the remaining composite fibers and the constituent fibers are not softened. Then, the web is molded and solidified so that a thickness thereof can range from 2 to 80 mm, and that an average apparent density thereof can range from 0.01 to 0.8 g/cm$^3$. The average apparent density mentioned herein refers to a density derived from an outer dimension and mass of the sound absorbing material. The measured dimension is obtained by general ruler, scale and the like, and the mass is obtained by a mass meter. Moreover, in this specification, the "softening point" refers to a temperature at which the material composing the fiber is softened by being heated and develops adhesiveness. Furthermore, the binder fiber mentioned herein refers to a fiber including a polymer in which a softening point is lower than a softening point of the composite fibers by at least 20° C., in which the softening point of the polymer is 70° C. or higher. The binder fibers may be composed only of such a component with the low softening point. Note that the reason why the temperature difference of the softening point of the binder fibers from the softening point of the composite fibers is set at least 20° C. is that it is necessary to maintain a shape of the non-woven fabric. Moreover, If the temperature difference between the softening points is decreased more than the above-described value, then the non-woven fabric is entirely softened, and turns to a plate shape when being pressed, causing a significant decrease of sound absorption performance. Meanwhile, if the softening point of the component with the low softening point falls down to 70° C. or lower, it becomes difficult to maintain the shape of the non-woven fabric in the case where the non-woven fabric is exposed to a high-temperature service condition.

Next, a description will be more specifically made of a production method of the cloth in the present invention while taking a production method of the non-woven fabric as an example herein.

First, predetermined fibers are fibrillated into a predetermined cut length, and are blended in an appropriate mixing ratio. Thereafter, the blended fibers are sprayed onto a conveyor by the carding method or the airlaid method, and are sucked according to needs, whereby a web is formed on the conveyor. Moreover, this web is compressed to have predetermined apparent density and thickness, and is molded and solidified by a hot wind or a heated steam at a predetermined temperature. Alternatively, the web on the conveyor may be finished to a specific thickness and a specific apparent density by needle punching, and may be subjected to such a heat treatment similarly.

The cloth of the present invention, that is, the non-woven fabric, which is obtained by the above-described production method, can stack a skin such as, for example, tricot, another non-woven fabric, and a woven fabric on at least one surface of an aggregate of the above-described fibers. A material of the skin is not particularly limited.

Moreover, the above-described carding method or airlaid method is used for forming the web, and a post-treatment process that follows is not particularly limited. Moreover, in such formation of the web, a spunbond method can also be used besides the carding method and the airlaid method.

In the present invention, it is preferable that the average cut length of the above-described constituent fibers be within a range of 20 to 200 mm. The reason for this is as follows. When the average cut length becomes less than 20 mm, the mutual entanglings of the fibers are reduced, and accordingly, aggregability of the fibers is deteriorated owing to reduction of contact points of the fused fibers, and further, it becomes difficult to hold the shape of the non-woven fabric at the time when the non-woven fabric is molded. In addition, when the non-woven fabric is attached to a vehicle, a building and the like, short fibers become flies, causing possibilities that the fibers may drop off from the aggregate thereof, and that the sound absorption performance may be decreased. Meanwhile, when the average cut length exceeds 100 mm, the mutual entanglings of the fibers are increased, and accordingly, the fibrillation thereof is insufficient and a density distribution of the aggregate becomes excessively large at the time of forming the web, causing an apprehension that such a problem may occur that the thickness and the quantity of airflow do not become constant in the non-woven fabric.

In the present invention, it is preferable that an average thickness of the cloth after the cloth is molded and processed be within a range of 2 to 80 mm. If the average thickness falls down below 2 mm, then the airflow resistance becomes too large, a desired airflow cannot be obtained, and it becomes difficult to obtain a sound absorption function. Meanwhile, if the average thickness exceeds 80 mm, then the apparent density of the sound absorbing material is decreased, the airflow resistance becomes too small, and it becomes difficult to obtain desired sound absorption performance.

It is preferable that the average apparent density of the cloth, that is, the non-woven fabric, which is molded and processed in accordance with the present invention, be within a range from 0.01 to 0.8 g/cm$^3$. The reason for this is as follows. If the average apparent density falls down below 0.01 g/cm$^3$, then a ratio of the fibers in a unit volume is decreased, and accordingly, it becomes difficult for the non-woven fabric to have sufficient aggregability. In addition, the airflow resistance is reduced, and sufficient sound absorption performance cannot be obtained. Meanwhile, if the average apparent density exceeds 0.8 g/cm$^3$, then the non-woven fabric becomes hard, the airflow resistance becomes too large, and satisfactory sound absorption performance cannot be obtained.

In accordance with the production method of the cloth according to the present invention, the cloth and the sound absorbing material, each of which has a drive direction, can be provided.

<Variable-Airflow Cloth>

The variable-airflow cloth of the present invention includes at least the above-described composite fibers. Then, the cloth such as the fabric, the knit and the non-woven fabric is composed by using the composite fibers as constituents. Moreover, the above-described variable-airflow cloth is one composed by attaching electrodes, and according to needs, lead wires and a power supply to the composite fibers or the cloth. Note that the electrodes can be fabricated by employing a publicly know method such that an electrical-conductive paste is applied to metal plates, and the lead wires are connected thereto.

Figure 22:
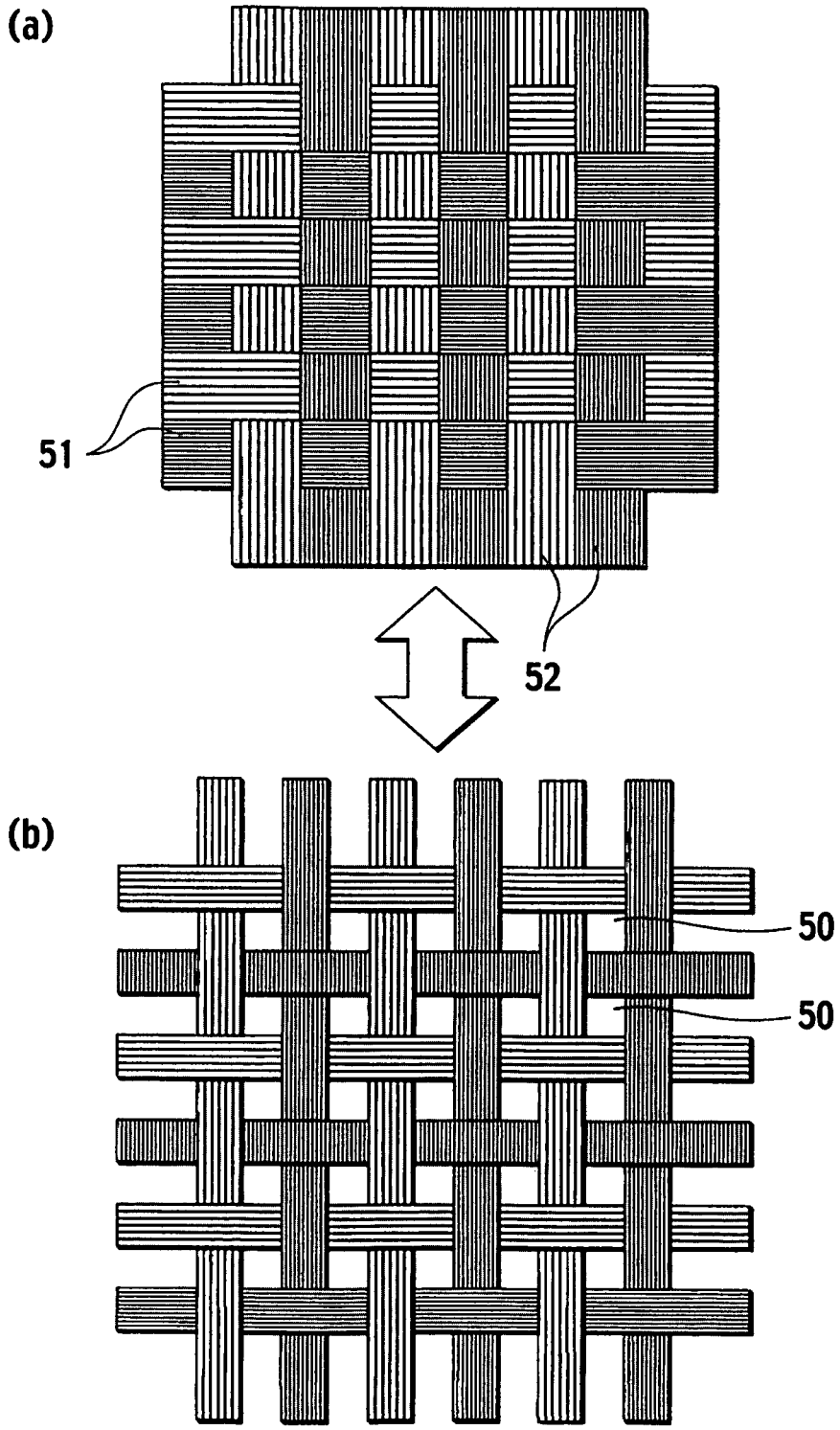
FIG. 22 is schematic views showing a motion of variable-airflow cloth (fabric) according to the present invention, the motion changing an airflow thereof.
Figure 23:
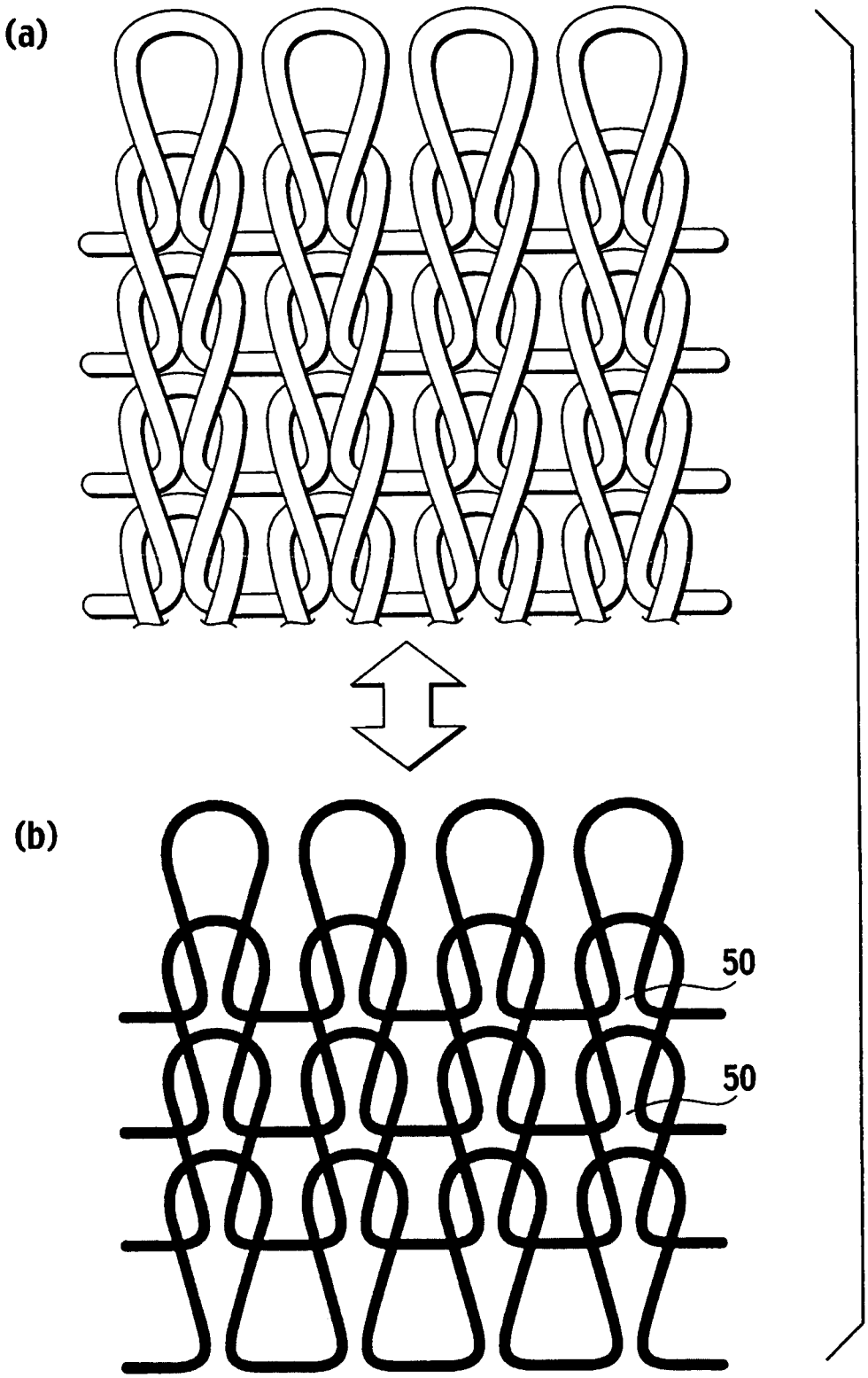
FIG. 23 is schematic views showing a motion of variable-airflow cloth (knit) according to the present invention, the motion changing an airflow thereof.

Features of the variable-airflow cloth will be described. At the time of the energization, the electrical-conductive polymeric component in the composite fibers shrinks, whereby, for example, the crimp of the composite fibers disappears, and there open woven interstices and knitted loops of the cloth such as the fabric, the knit and the non-woven fabric or spatial portions of the cloth. As a result, the quantity of airflow is increased. On the other hand, when the energization is stopped, the electrical-conductive polymeric component returns to an original state thereof, and the crimp of the composite fibers is developed again, whereby such spatial portions close, and the quantity of airflow is reduced. Specifically, as shown in FIG. 22, in the case of a plain-woven fabric formed of weft yarns 51 and warp yarns 52, which are composed of the composite fibers, at the time of the energization, the woven interstices open, and gaps 50 are formed, and as a result, the quantity of airflow is increased ((b) in FIG. 22). On the other hand, when the energization is stopped, the woven interstices close, and the quantity of airflow is reduced ((a) in FIG. 22). Moreover, in the case of a plain-woven fabric formed of the composite fibers, at the time of the energization, the knitted loops open, and gaps 50 are formed, and as a result, the quantity of airflow is increased ((b) in FIG. 23). On the other hand, when the energization is stopped, the knitted loops close, and the quantity of airflow is reduced ((a) in FIG. 23).

A regulated power supply that is general or the like can be used as the power supply that applies a voltage in order to change the quantity of airflow. A deformation amount of the variable-airflow cloth differs depending on the voltage applied here; however, if the power supply is used within a voltage range from 1 to 10V, then it is possible to repeat the reversible crimp-extension of the composite fibers.

This reversible motion of the composite fibers occurs in the cloth, whereby the above-described change of the quantity of airflow can be caused.

Figure 24:
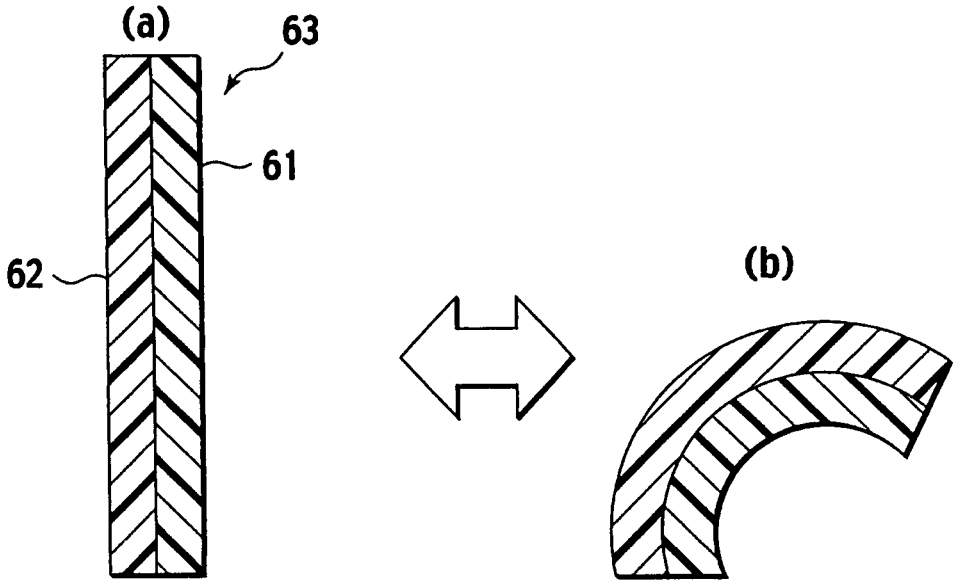
FIG. 24 is schematic views showing a motion of a composite fiber according to the present invention.

It is also possible to reverse an order of such motions of the crimp-extension at the time of the energization by the material stacked on the electrical-conductive polymer. Specifically, as shown in (a) of FIG. 24, if a stacked material is selected in advance so as to take an extended form in a state before the energization, then, by the shrinkage of the electrical-conductive polymer at the time of the energization, a behavior to crimp, that is, to bend while taking the electrical-conductive polymer side as an inside occurs as shown in (b) of FIG. 24. Note that, in the drawings, reference numeral 61 denotes the electrical-conductive polymeric component, reference numeral 62 denotes a component composed of the other material, and reference numeral 63 denotes the composite fiber.

Figure 25:
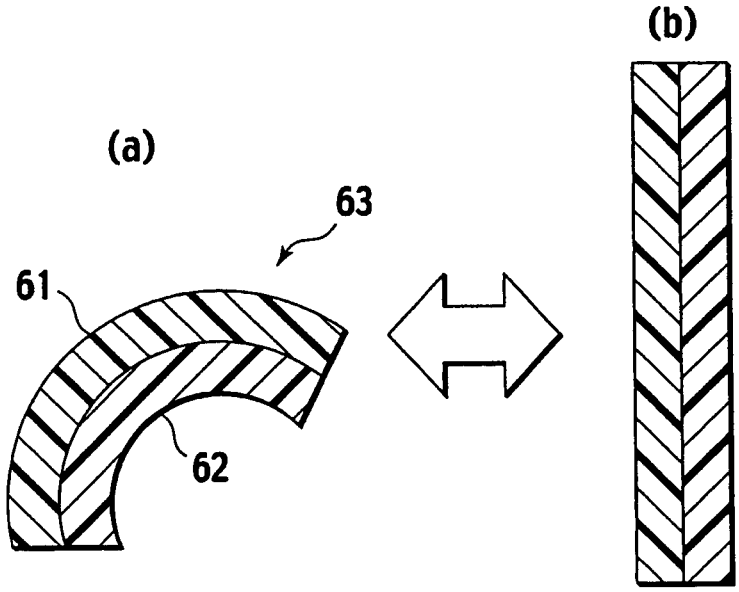
FIG. 25 is schematic views showing a motion of the composite fiber according to the present invention.

In the case of making a combination in which the crimp occurs in advance, the electrical-conductive polymeric component before the energization is stacked on the other material in a state of being apparently swelled, whereby a state where the composite fiber is crimped, that is, bent while taking the electrical-conductive polymer side as an outside can be obtained. When the energization is performed from this state, as shown in (a) and (b) of FIG. 25, the electrical-conductive polymer shrinks, whereby the crimp is released, and a motion in an extending direction occurs. The energization is further continued, whereby the crimp occurs again as in FIG. 24 if there is room to allow the shrinkage of the electrical-conductive polymer. Such a combination can be selected and set by using a thermal shrinkage difference in between a temperature at which the material is formed into the fiber and the normal temperature.

Figure 26:
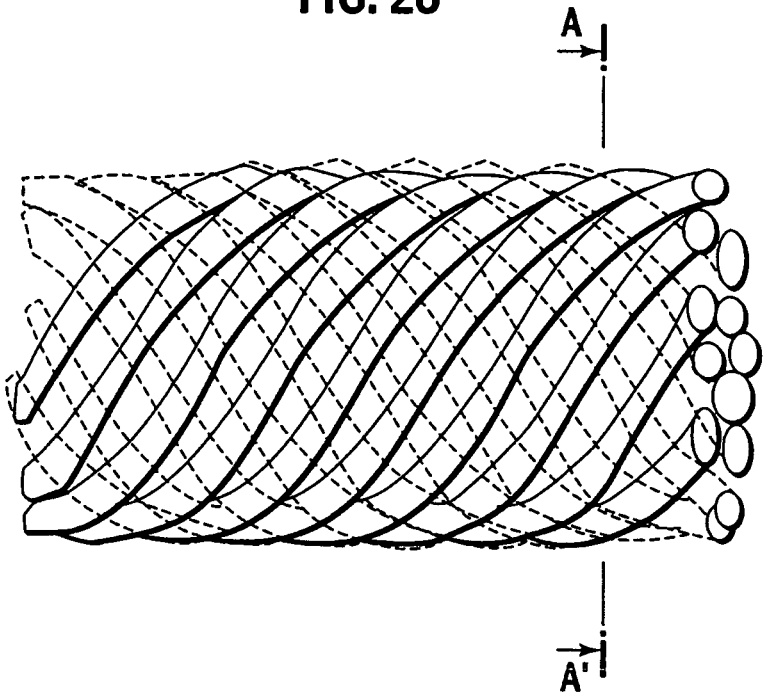
FIG. 26 is a schematic view showing a fiber aggregate and yarns, which are according to the present invention.

In order to obtain a larger difference of the quantity of airflow, it is preferable to use the composite fibers by being bundled as an aggregate thereof as shown in FIG. 26 or bundled as the twisted yarns.

Figure 27:
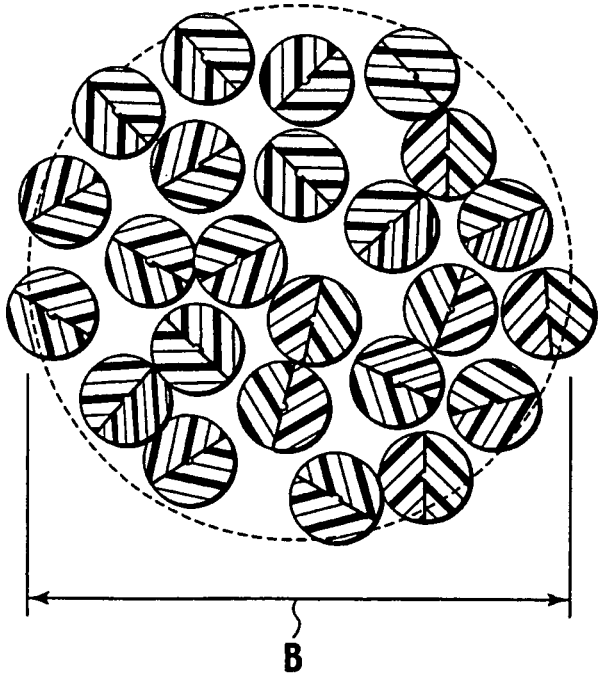
FIG. 27 is a schematic cross-sectional view of a fiber aggregate and yarns, which are according to the present invention.
Figure 28:
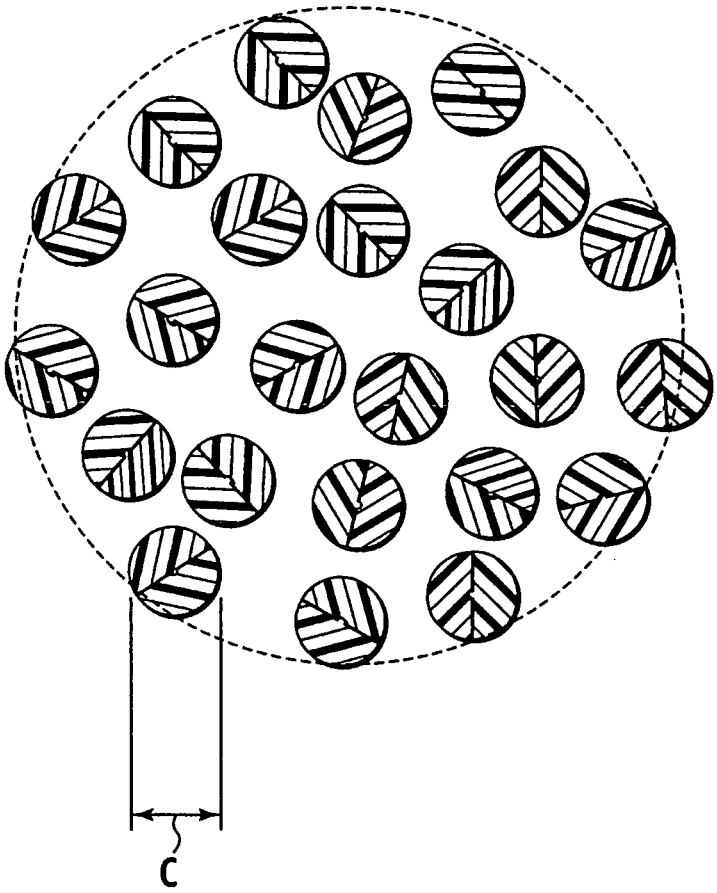
FIG. 28 is a schematic cross-sectional view of a fiber aggregate and yarns, which are according to the present invention.

In the aggregate of the composite fibers gathered in advance, as shown in FIG. 27, a state is brought, where the diameter fiber is large in a pseudo manner in a state where the composite fibers are brought into intimate contact with one another. In comparison with cloth that takes a state where the fiber diameter directly leads to the airflow resistance and the quantity of airflow is small, a state is taken, in which the total surface area of the fibers, which affects the airflow of the cloth, is reduced in a pseudo manner and the quantity of airflow is increased in a state where the composite fibers are raveled completely the diameter is increased in a pseudo manner. By using this phenomenon, a state is made, where the fiber diameter is large in a pseudo manner in advance by the aggregate of the composite fibers (FIG. 27), and a state is made, where the aggregate of the composite fibers is raveled by being applied with the crimp, and the fiber diameter is reduced in a pseudo manner (FIG. 28). The energization is performed and stopped between both of the states, whereby it becomes possible to obtain the larger change of the airflow, and eventually, the change of the sound absorption coefficient.

On the contrary, a method can also be employed, in which an aggregate of loosely gathered fibers is prepared in advance, and the crimp of the fibers is eliminated by the shrinkage caused by the energization, whereby the airflow is increased.

Figure 31:
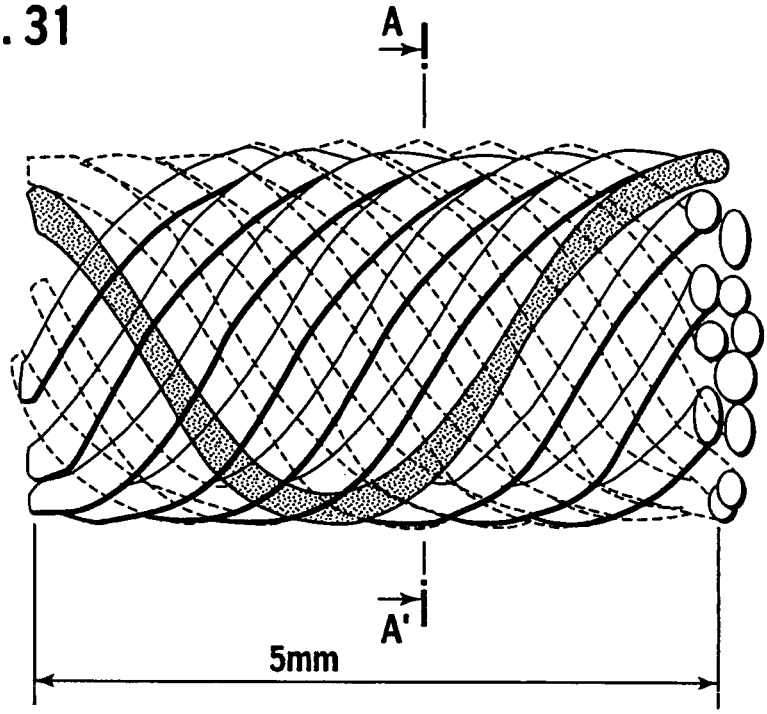
FIG. 31 is a schematic view showing a shape of Example II-1 of the present invention.

As the aggregate of the composite fibers, besides the above-described ones, there can be mentioned: a fiber bundle (FIGS. 29 and 30) in which the composite fibers are arranged along the surface layer side of the bundle of the fibers; a fiber bundle (FIGS. 31 to 33) in which the composite fibers are arranged in a spiral shape along the surface layer side of the bundle of the fibers; and the like.

Figure 34:
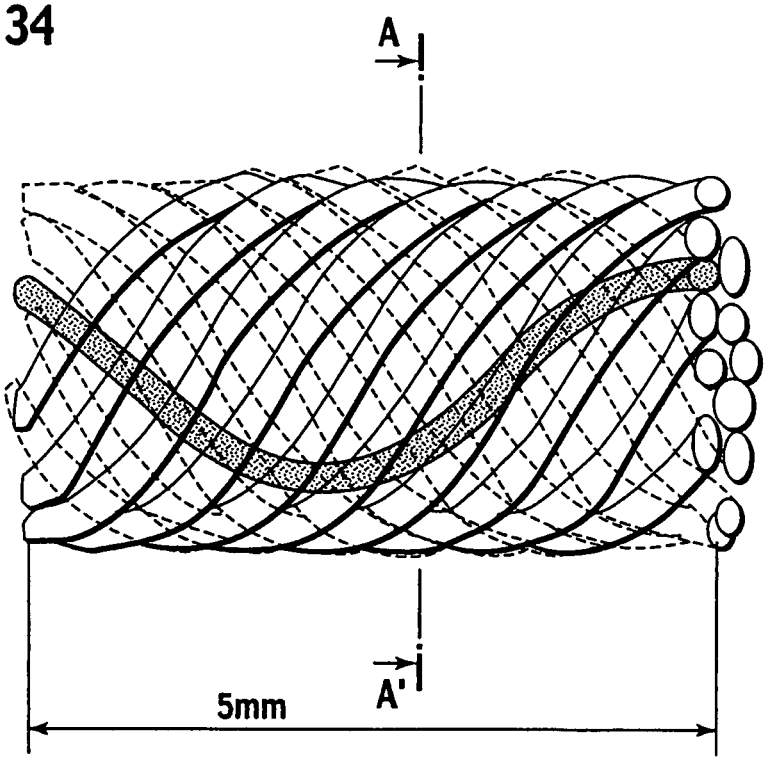
FIG. 34 is a schematic view showing a shape of Example II-8 of the present invention.
Figure 35:
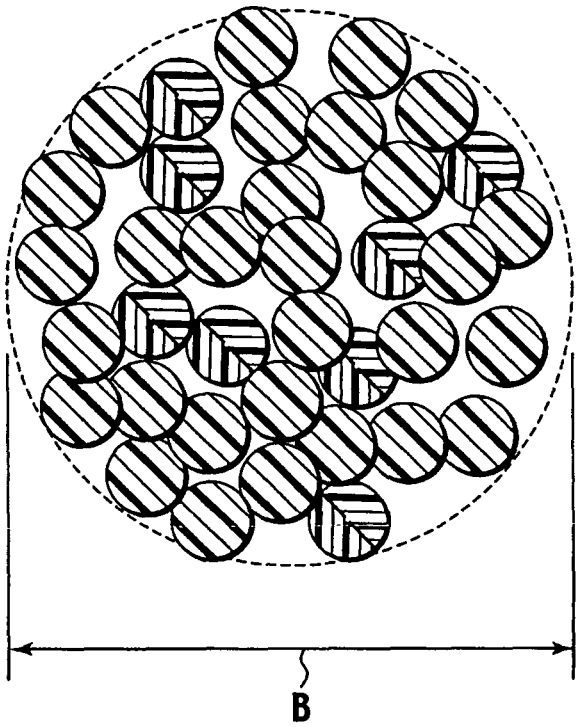
FIG. 35 is a schematic cross-sectional view along a line A-A' of FIG. 34.

Moreover, even in the case of forming this aggregate of the fibers into a twisted yarn shape, a raveled state in advance and a sharply twisted state are used property, whereby the airflow is facilitated to be controlled (FIGS. 34 and 35).

Figure 36:
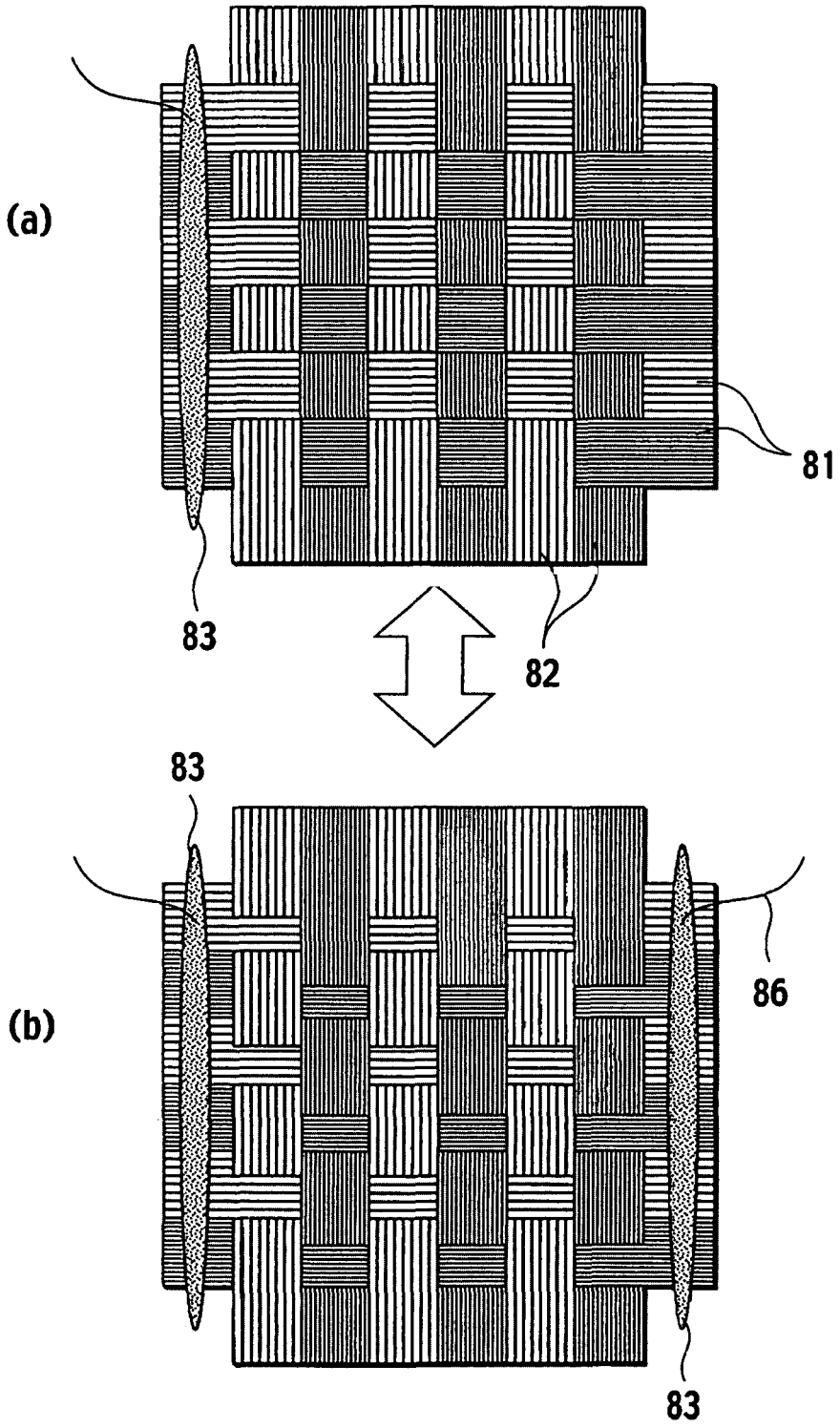
FIG. 36 is schematic views showing shapes of a plain-woven fabric.

Moreover, as shown in FIG. 36, the fiber bundles composed of the crimped yarns and the composite fibers used as weft yarns 81, and fiber bundles composed only of the crimped yarns are used as warp yarns 82, whereby cloth (plain-woven fabric) can be fabricated. As a matter of course, the composite fibers may be contained in both of the yarns. In (a) and (b) of FIG. 36, a mode is shown, where the cloth attached with electrodes 83 and lead wires 86 is energized, whereby the weft yarns are thinned.

In order to obtain the reversible variable-airflow cloth having the features as described above, it is preferable that the composite fibers be contained by 10 mass % or more in the cloth though no particular limitations are imposed thereon.

Note that, in FIGS. 27, 30, 32, 33 and 35, reference symbol B denotes the pseudo fiber diameters. Moreover, in FIG. 28, reference symbol C denotes a fiber diameter of each of the fibers.

(Sound Absorbing Material)

The cloth of the present invention, in which the air permeability is variable by the energization, can be used as a sound absorbing material. In order to largely obtain the change of the sound absorption coefficient in the sound absorbing material, it is more desirable that the composite fibers be contained by 20 mass % or more in the cloth.

It is preferable that the quantity of airflow for obtaining the sound absorption performance be within a range from 10 to 300 $cm^3/cm^2 \cdot s$. By setting the quantity of airflow within this range, a normal incidence sound absorption coefficient (JIS A1405; Acoustics—Determination of sound absorption coefficient and impedance in impedance tubes: Method using standing wave ratio) will range from 0.2 to 0.7 at a wavelength of 1 kHz.

(Vehicular Part)

The cloth of the present invention, in which the air permeability is variable by the energization, can be applied to a vehicle. Sound absorbing materials having a new changing performance for the sound absorption coefficient can be applied to the vehicle. Conventional sound absorbing materials are replaced by these sound absorbing materials, thus making it possible to newly impart a function to change the sound absorption coefficient to the sound absorbing material.

Figure 37:
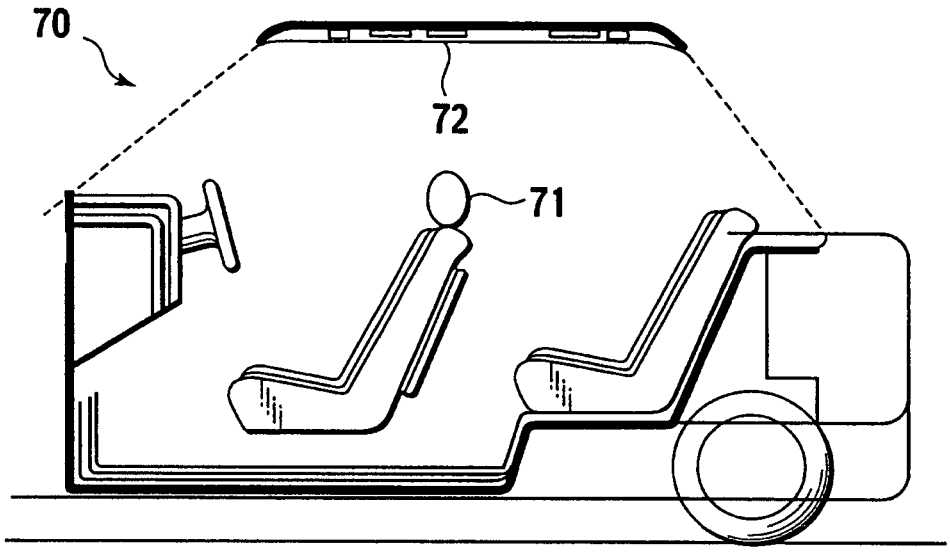
FIG. 37 is a schematic view showing an installed position of a vehicular part according to the present invention.

For example, as shown in FIG. 37, the sound absorbing materials can be arranged on a headrest 71 and ceiling material 72 of a vehicle 70. When the sound absorption coefficients are changed in such a vehicular part close to the passenger's ears, the passenger can be made to sense that change.

In this vehicular part, the shrinkage and extension of the composite fibers can be performed repeatedly at a voltage for use in a usual vehicle.

A description will be more specifically made below of the present invention based on examples.

EXAMPLE 1

Electrical-conductive polymeric fibers were fabricated by a wet spinning method. Specifically, acetone (Code No. 019-00353, made by Wako Pure Chemical Industries, Ltd.) was used for a solvent phase, and PEDOT/PSS (Baytron P (registered trademark)) as an electrical-conductive polymeric component was extruded from a microsyringe (MS-GLL100 made by Ito Corporation; inner diameter of needle portion: 260 μm) at a speed of 0.5 mL/h, whereby electrical-conductive polymeric fibers with a diameter of approximately 10 μm were obtained. Next, an aqueous polyester emulsion (AA-64, made by Nippon NSC Ltd.) was applied on surfaces of the fibers, followed by drying at 25° C. for 24 hours. Composite fibers thus obtained had a crescent cross-sectional shape of a stack type, and a diameter thereof was approximately 17 μm.

Next, a web was formed of mixed fibers composed of 80 mass % of the composite fibers cut to an average cut length of 50 mm and 20 mass % of binder fibers [core component: PET; sheath component: copolymer polyester (amorphous polyester); softening point: 110° C.] with a diameter of 14 μm by the carding method. Then, the web was compressed to a specific thickness (approximately 8 mm), and was then heated at 160° C. for seven minutes, whereby cloth with an average apparent density of 0.025 $g/cm^3$ and a thickness of 10 mm was obtained.

Figure 38:
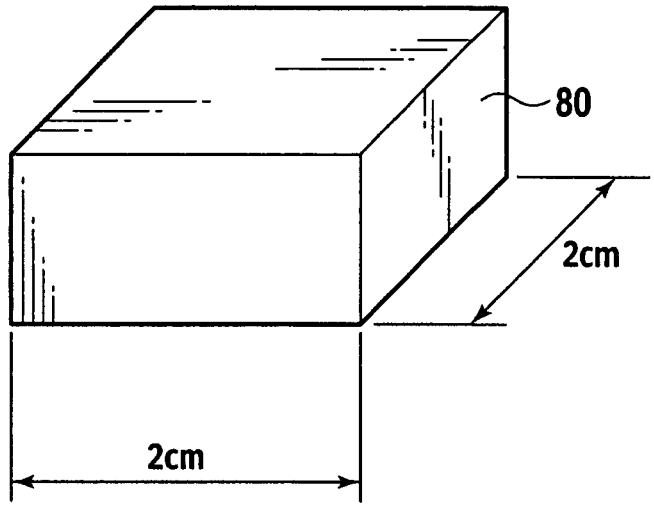
FIG. 38 is schematic views of variable-airflow cloth according to the present invention.
Figure 38:
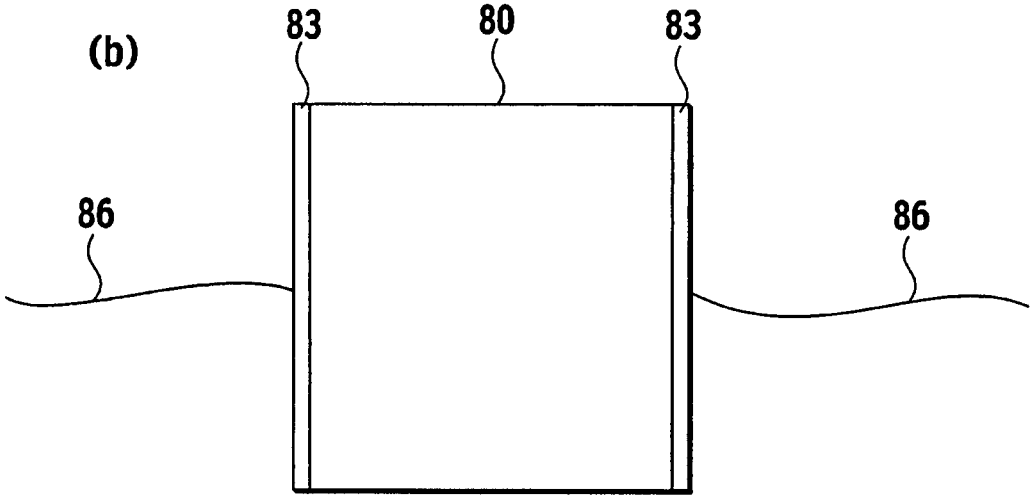

Next, as shown in (a) of FIG. 38, this cloth 80 was cut out to a square of 2 cm×2 cm for evaluating an airflow. Then, an electrical-conductive paste (D-500 made by Fujikura Kasei Co., Ltd.) was applied as the electrodes 83 for power supply connection on positions shown in (b) of FIG. 38, and copper wires (CU-111086 made by The Nilaco Corporation) with a diameter of 0.025 mm were connected as the electric wires 86 to the electrodes 83. In such a way, variable-airflow cloth was obtained.

Figure 39:
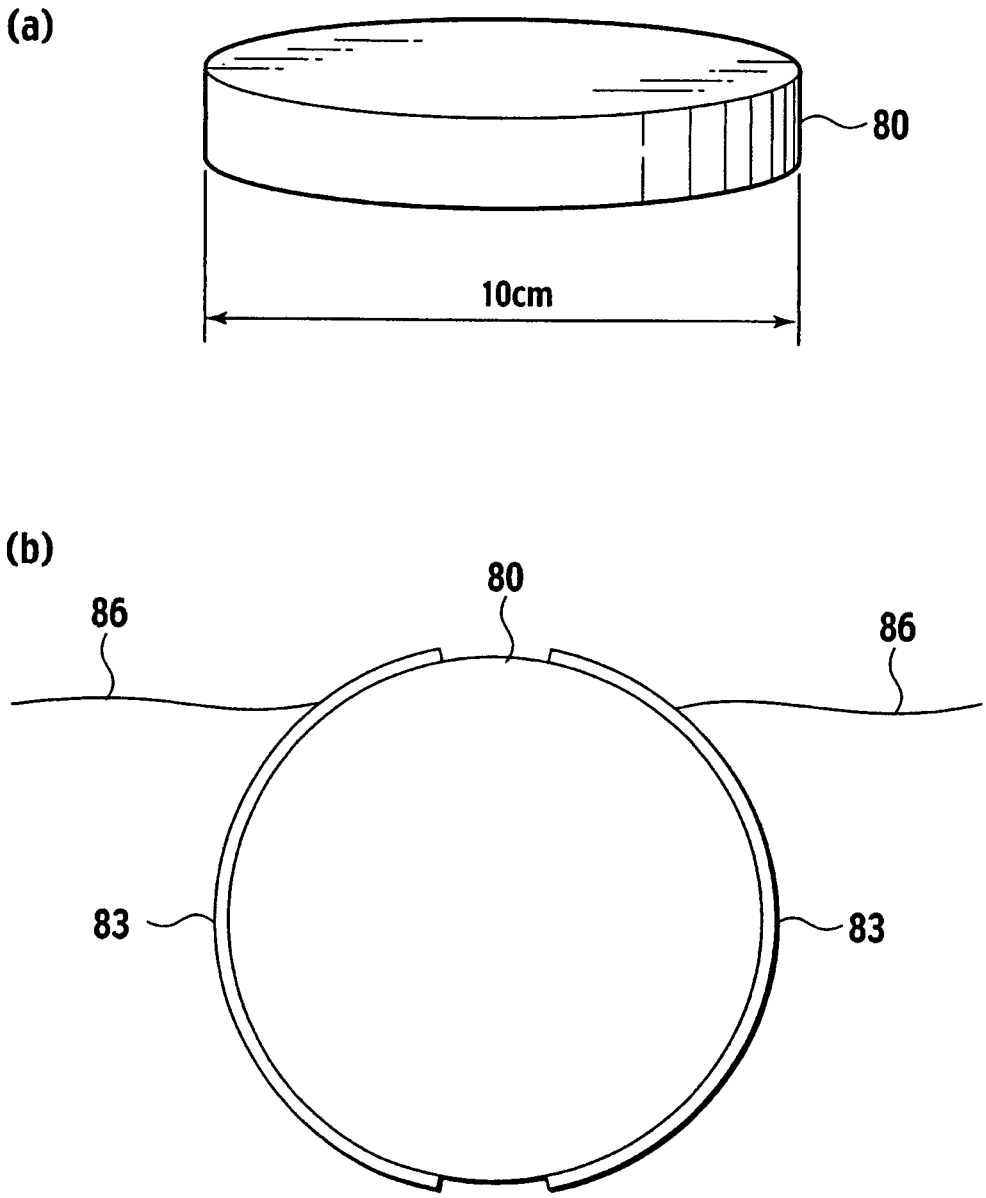
FIG. 39 is schematic views of variable-airflow cloth according to the present invention.

Moreover, as shown in (a) of FIG. 39, this cloth 80 was cut out to a circle with a diameter of 10 cm for evaluating a sound absorption coefficient. Then, in a similar way to the above, the electrodes 83 and the electric wires 86 for the power supply connection were connected to positions shown in (b) of FIG. 39. In such a way, the variable-airflow cloth was obtained.

EXAMPLE 2

Figure 40:
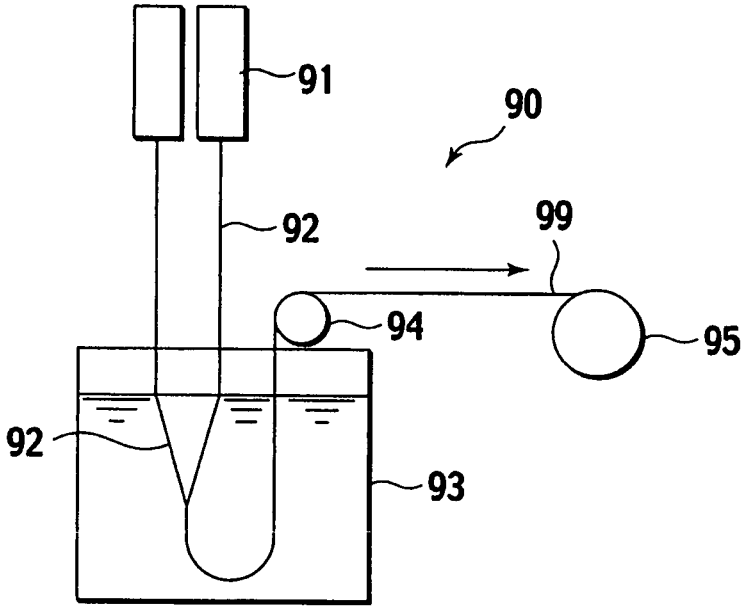
FIG. 40 is a schematic view of a wet spinning machine according to the present invention.

Composite fibers were fabricated by a wet spinning method similar to that in Example 1. Specifically, acetone was used for a solvent phase, and PEDOT/PSS (Baytron P (registered trademark)) as an electrical-conductive polymeric component and an aqueous solution prepared by diluting a water dispersion (Product No. 56122-3 made by Aldrich Corporation) of polystyrenesulfonate (PSS) to 10 times were extruded from two microsyringes (MS-GLL100 made by Ito Corporation; inner diameter of needle portion: 260 μm) at a speed of 0.5 mL/h into the same solvent phase. In such a way, composite fibers were obtained, in which a cross section had a shape shown in (n) of FIG. 13, and a length of the longest portion of the cross section was approximately 14 μm. In a wet spinning machine 90 shown in FIG. 40, such spinning raw liquids were extruded from two wet spinning mouthpieces 91, and extruded precursors 92 of the composite fibers were made to pass through a wet spinning solvent bath 93 that contains the solvent such as acetone. The precursors 92 passed through the solvent bath 93, and then passed through a fiber feeder 94, thereby becoming a composite fiber 99. The composite fiber 99 was spooled by a fiber spool 95. By using this composite fiber, variable-airflow cloth was obtained in a similar way to Example 1.

Electrical-conductive polymeric fibers with a diameter of approximately 10 μm were obtained by a wet spinning method similar to that in Example 1. Next, an aqueous polyester emulsion (AA-64, made by Nippon NSC Ltd.) was applied on surfaces of the electrical-conductive polymeric fibers in a continuous process, followed by drying at 70° C.

Fibers thus obtained had an eccentric circular cross-sectional shape of a core-sheath type, and a diameter thereof was 17 μm. By using the composite fibers thus obtained, variable-airflow cloth was obtained in a similar way to Example 1.

EXAMPLE 4

By a wet spinning method similar to that in Example 2, composite fibers were obtained, in which a length of the longest portion of a cross section was approximately 14 μm. Next, 100 composite fibers thus obtained were bundled to form an aggregate. Next, a web was formed of mixed fibers composed of 80 mass % of the aggregate of the fibers cut to an average cut length of 50 mm and 20 mass % of binder fibers [core component: PET; sheath component: copolymer polyester (amorphous polyester); softening point: 110° C.] with a diameter of 14 μm by the airlaid method. Then, the web was compressed to a specific thickness (approximately 8 mm), and was then heated at 160° C. for seven minutes, whereby cloth with an average apparent density of 0.025 $g/cm^3$ and a thickness of 10 mm was obtained. By using this cloth, variable-airflow cloth was obtained in a similar way to Example 1.

EXAMPLE 5

By a wet spinning method similar to that in Example 2, composite fibers were obtained, in which a length of the longest portion of a cross section was approximately 14 μm. Next, an aggregate formed by bundling 100 fibers thus obtained was formed into a twisted yarn that was twisted four times per 10 cm. Moreover, a web was formed of mixed fibers composed of 80 mass % of such twisted yarns cut to an average cut length of 50 mm and 20 mass % of binder fibers [core component: PET; sheath component: copolymer polyester (amorphous polyester); softening point: 110° C.] with a diameter of 14 μm by the airlaid method. Then, the web was compressed to a specific thickness (approximately 8 mm), and was then heated at 160° C. for seven minutes, whereby cloth with an average apparent density of 0.025 g/cm$^3$ and a thickness of 10 mm was obtained. By using this cloth, variable-airflow cloth was obtained in a similar way to Example 1.

EXAMPLE 6

A fiber was synthesized from an electrical-conductive polymer by an electrospinning method. Specifically, as a raw liquid, a solution was used, which was obtained by adding methanol to a 2.5% aqueous solution of paraxylene tetrahydrothiophenium chloride so that a volume of methanol could be 50 vol %. This solution was ejected from a needle tip with an inner diameter of 340 μm onto an aluminum foil board located below the needle tip by 20 cm while applying a voltage of 5 kV to the needle tip, whereby a precursor fiber was deposited on the board. The precursor fiber thus obtained was subjected to vacuum drying at 250° C. for 24 hours, and nanofibers thus obtained were formed into a twisted yarn, and electrical-conductive polymeric fibers with a diameter of approximately 10 μm were obtained. Next, an aqueous polyester emulsion (AA-64, made by Nippon NSC Ltd.) was applied on surfaces of the fibers, followed by drying at 25° C. for 24 hours. Composite fibers thus obtained had a crescent cross-sectional shape of a stack type, and a diameter thereof was approximately 17 μm. By using the composite fibers, variable-airflow cloth was obtained in a similar way to Example 1.

EXAMPLE 7

Electrical-conductive polymeric fibers with a diameter of approximately 10 μm were obtained by a wet spinning method similar to that in Example 1. Next, an aqueous polyester emulsion (AA-28, made by Nippon NSC Ltd.) was applied on surfaces of the electrical-conductive polymeric fibers in a continuous process so that a final fiber diameter could be 17 μm, followed by drying at 70° C. Fibers in which the fiber diameter was obtained had a crescent cross-sectional shape of a stack type, and a diameter thereof was approximately 17 μm. By using the composite fibers, variable-airflow cloth was obtained in a similar way to Example 1.

COMPARATIVE EXAMPLE 1

Cloth in which electrodes and electric wires were arranged in a similar way to Example 1 was obtained except for using polyethylene terephthalate (PET) with a diameter of 15 μm, in which an average cut length was 51 mm, in place of the composite fibers.

COMPARATIVE EXAMPLE 2

Cloth in which electrodes and electric wires were arranged in a similar way to Comparative example 1 was obtained except for using a fiber aggregate in which 100 pieces of polyethylene terephthalate (PET) with a diameter of 15 μm, in which an average cut length was 51 mm, were bundled, and for using the airlaid method for the web formation step.

COMPARATIVE EXAMPLE 3

Cloth in which electrodes and electric wires were arranged in a similar way to Comparative example 2 was obtained except for forming the fiber aggregate of Comparative example 2 into a twisted yarn that was twisted four times per 10 cm.

COMPARATIVE EXAMPLE 4

Cloth in which electrodes and electric wires were arranged in a similar way to Example 1 was obtained except for obtaining the cloth without performing the emulsion application of Example 1.

COMPARATIVE EXAMPLE 5

Cloth in which electrodes and electric wires were arranged in a similar way to Example 1 was obtained except for obtaining the cloth without performing the emulsion application of Example 6.

[Evaluation Test 1] Quantity of Airflow

Quantities of airflow in these examples were measured by an airflow testing machine FX 3300 made by TexTest, which conforms to JIS L1096 (Testing methods for woven fabrics, 8. 27. 1 method A (Frajour type testing method)), in a steady temperature and humidity room at a temperature of 20° C. and an RH of 65%.

[Evaluation Test 2] Sound Absorption Coefficient

Normal incidence sound absorption coefficients of these examples were measured by an impedance tube made by B&K in conformity with JIS A1405 (Acoustics—Determination of sound absorption coefficient and impedance in impedance tubes: Method using standing wave ratio) in a steady temperature and humidity room at a temperature of 20° C. and an RH of 65%.

[Energization Method]

In order to energize the samples for use in the respective evaluation tests, a direct-current regulated power supply was used. With regard to measurements in the case of turning on the power supply, the evaluations were performed on and after elapse of five minutes since the power supply was turned on. Results of these evaluations are shown in Table 1.

TABLE 1

| | Electrical-conductive polymer | Surface layer material | Cross section Shape | Area ratio (conductor:surface layer) | Fiber | Collection method | Evaluation test 1 Quantity of airflow [cm/s] OFF | ON | Evaluation 2 Sound absorption coefficient [—] OFF | ON |
|---|---|---|---|---|---|---|---|---|---|---|
| Example 1 | PEDOT/PSS | PET | stack/crescent | 1:2 | single fiber | card layer | 61 | 124 | 0.44 | 0.27 |
| Example 2 | PEDOT/PSS | PSS | side-by-side | 1:1 | single fiber | card layer | 60 | 155 | 0.44 | 0.24 |
| Example 3 | PEDOT/PSS | PET | core-sheath/ eccentric circle | 1:2 | single fiber | card layer | 61 | 119 | 0.43 | 0.30 |
| Example 4 | PEDOT/PSS | PSS | side-by-side | 1:1 | aggregate | air layer | 66 | 182 | 0.37 | 0.22 |
| Example 5 | PEDOT/PSS | PSS | side-by-side | 1:1 | twisted aggregate | air layer | 66 | 203 | 0.37 | 0.20 |
| Example 6 | PPV | PET | stack/crescent | 1:2 | single fiber | card layer | 55 | 102 | 0.42 | 0.31 |
| Example 7 | PEDOT/PSS | PMMA | stack/crescent | 1:2 | single fiber | card layer | 60 | 97 | 0.43 | 0.38 |
| Comparative example 1 | — | PET | uniformly circular cross section | — | single fiber | card layer | 66 | 66 | 0.36 | 0.36 |
| Comparative example 2 | — | PET | uniformly circular cross section | — | aggregate | air layer | 78 | 78 | 0.29 | 0.29 |
| Comparative example 3 | — | PET | uniformly circular cross section | — | twisted aggregate | card layer | 79 | 79 | 0.29 | 0.29 |
| Comparative example 4 | PEDOT/PSS | — | uniformly circular cross section | — | single fiber | card layer | 58 | 58 | 0.44 | 0.44 |
| Comparative example 5 | PPV | — | uniformly circular cross section | — | single fiber | card layer | 55 | 55 | 0.43 | 0.43 |

From Table 1, the following is understood.

1. When the voltage was applied to the samples, the quantities of airflow and the sound absorption coefficients were changed.

2. Any value was not changed in Comparative examples.

EXAMPLE 8

The variable-airflow cloth of Example 1 was cut to a square of 10 cm, and was disposed on a headrest of a driver's seat of a vehicle.

The variable-airflow cloth was energized with 12V, and ON-OFF of the energization was repeated every one minute. Then, a change of a sound pressure by an ear side of the driver's seat was able to be observed. Moreover, a passenger seated on the driver's seat was also able to sense the change. It was recognized that the variable-airflow cloth was a material capable of repeatedly performing the increase and reduction of the sound absorption coefficient.

EXAMPLE II-1

Examples using the variable-fiber-diameter bundle and comparative examples will be shown below as series II.

Electrical-conductive polymeric fibers were fabricated by a wet spinning method. Specifically, acetone (Code No. 019-00353, made by Wako Pure Chemical Industries, Ltd.) was used for a solvent phase, and a 1.3% water dispersion of PEDOT/PSS (Baytron P-AG (registered trademark) made by H.C. Starck) as an electrical-conductive polymeric component was extruded from a microsyringe (MS-GLL100 made by Ito Corporation; inner diameter of needle portion: 260 μm) at a speed of 0.5 mL/h, whereby electrical-conductive polymeric fibers with a diameter of approximately 10 μm were obtained. Next, an aqueous polyester emulsion (AA-64, made by Nippon NSC Ltd.) was applied on surfaces of the fibers, followed by drying at 25° C. for 24 hours. Composite fibers thus obtained had a crescent cross-sectional shape of a stack type, and a diameter thereof was approximately 17 μm.

Moreover, as crimped yarns, polyester long fibers (side-by-side type, made by Kanebo Gohsen, Ltd.) with a diameter of 15 μm were used.

92 crimped yarns were used, and were further twisted to form a bundle. Moreover, around a surface layer side of the bundle, four bundles of the composite fibers, each having two composite fibers, were wound in a spiral shape so that each of the bundles could be wound one time every 5 mm of a length in the longitudinal direction (refer to FIGS. 31 and 32).

Figure 41:
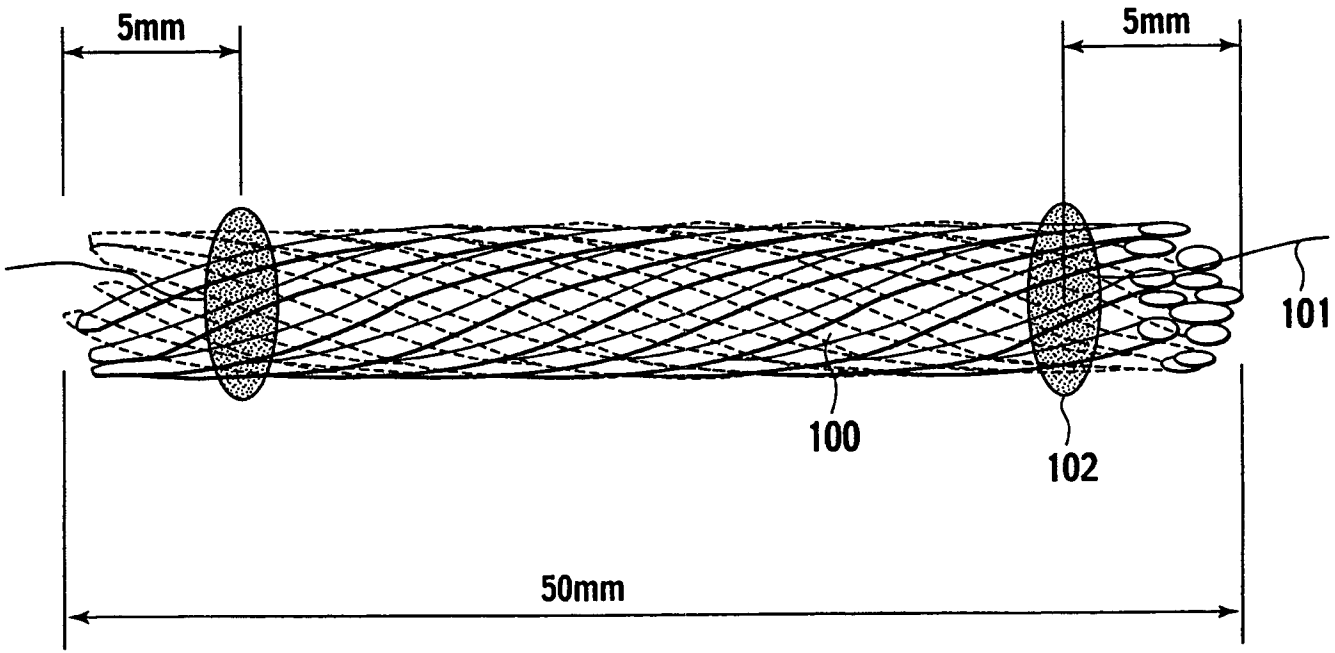
FIG. 41 is a schematic view showing a shape of a bundle of variable-fiber-diameter fibers, which is used in the present invention.

Next, as shown in FIG. 41, a fiber bundle 100 was cut out to a length of 5 cm, and copper wires 101 (CU-111086 made by The Nilaco Corporation) with a diameter of 0.025 mm were fixed to positions apart by 5 mm from both end portions thereof by an electrical-conductive paste 102 (D-500 made by Fujikura Kasei Co., Ltd.), and were used as electrodes, whereby a variable-fiber-diameter bundle was obtained (refer to FIG. 41).

An apparent outer diameter of the variable-fiber-diameter bundle at the time when no energization was performed therefor was measured by a micrometer. Then, the apparent outer diameter was approximately 590 μm.

EXAMPLE II-2

A variable-fiber-diameter bundle was obtained in a similar way to Example II-1 except for using 450 polyester long fibers (side-by-side type, made by Kanebo Gohsen, Ltd.) with a diameter of 7 μm.

An apparent outer diameter of the variable-fiber-diameter bundle at the time when no energization was performed therefor was measured by a micrometer. Then, the apparent outer diameter was approximately 630 μm.

EXAMPLE II-3

A variable-fiber-diameter bundle was obtained in a similar way to Example II-1 except for changing the number of crimped yarns to 1100.

An apparent outer diameter of the variable-fiber-diameter bundle at the time when no energization was performed therefor was measured by a micrometer. Then, the apparent outer diameter was approximately 1870 μm.

EXAMPLE II-4

A variable-fiber-diameter bundle was obtained in a similar way to Example II-1 except for using four bundles of the composite fibers, each having four composite fibers, and for changing the number of crimped yarns to 84.

An apparent outer diameter of the variable-fiber-diameter bundle at the time when no energization was performed therefor was measured by a micrometer. Then, the apparent outer diameter was approximately 410 μm.

EXAMPLE II-5

A variable-fiber-diameter bundle was obtained in a similar way to Example II-1 except for changing the number of composite fibers to 40 and the number of crimped yarns to 1100.

An apparent outer diameter of the variable-fiber-diameter bundle at the time when no energization was performed therefor was measured by a micrometer. Then, the apparent outer diameter was approximately 1440 μm.

EXAMPLE II-6

A variable-fiber-diameter bundle was obtained in a similar way to Example II-1 except for adopting a structure in which each of eight composite fibers was wound in a spiral shape around a surface layer side so as to be wound one time every 5 mm of a length in the longitudinal direction (refer to FIG. 33)

An apparent outer diameter of the variable-fiber-diameter bundle at the time when no energization was performed therefor was measured by a micrometer. Then, the apparent outer diameter was approximately 590 μm.

EXAMPLE II-7

Figure 29:
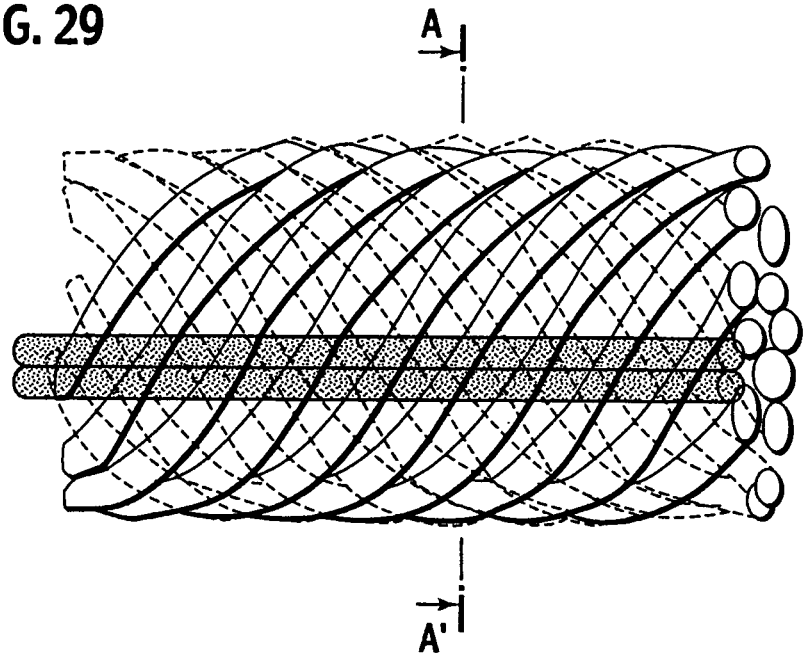
FIG. 29 is a schematic view showing a shape of Example II-7 of the present invention.

A variable-fiber-diameter bundle was obtained in a similar way to Example II-1 except for adopting a structure in which, on a surface layer side thereof, four bundles of the composite fibers, each having two composite fibers, were arranged along a longitudinal direction of the crimped yarns (refer to FIGS. 29 and 30).

An apparent outer diameter of the variable-fiber-diameter bundle at the time when no energization was performed therefor was measured by a micrometer. Then, the apparent outer diameter was approximately 590 μm.

EXAMPLE II-8

A variable-fiber-diameter bundle was obtained in a similar way to Example II-5 except for bundling and twisting 40 composite fibers and 1100 crimped yarns so that the composite fibers and the crimped yarns could be randomly mixed on a cross-sectional direction (refer to FIGS. 34 and 35).

An apparent outer diameter of the variable-fiber-diameter bundle at the time when no energization was performed therefor was measured by a micrometer. Then, the apparent outer diameter was approximately 1920 μm.

EXAMPLE II-9

A variable-fiber-diameter bundle was obtained in a similar way to Example II-1 except for using 92 crimped yarns as a bundle without twisting the crimped yarns.

An apparent outer diameter of the variable-fiber-diameter bundle at the time when no energization was performed therefor was measured by a micrometer. Then, the apparent outer diameter was approximately 660 μm.

EXAMPLE II-10

A variable-fiber-diameter bundle was obtained in a similar way to Example II-5 except for adopting a structure in which 40 composite fibers were divided into bundles, each having two composite fibers, and each of the respective bundles was wound in a spiral shape around a surface layer side of the bundle of the crimped yarns so as to be wound one time every 5 mm of a length in the longitudinal direction.

An apparent outer diameter of the variable-fiber-diameter bundle at the time when no energization was performed therefor was measured by a micrometer. Then, the apparent outer diameter was approximately 1350 μm.

EXAMPLE II-11

A variable-fiber-diameter bundle was obtained in a similar way to Example II-5 except for adopting a structure in which 40 composite fibers were divided into bundles, each having 20 composite fibers, and each of the respective bundles was wound in a spiral shape around a surface layer side of the bundle of the crimped yarns so as to be wound one time every 5 mm of a length in the longitudinal direction.

An apparent outer diameter of the variable-fiber-diameter bundle at the time when no energization was performed therefor was measured by a micrometer. Then, the apparent outer diameter was approximately 1720 μm.

EXAMPLE II-12

A variable-fiber-diameter bundle was obtained in a similar way to Example II-5 except for adopting a structure in which 40 composite fibers were formed into one bundle, and the bundle was wound in a spiral shape around a surface layer side of the bundle of the crimped yarns so as to be wound one time every 5 mm of a length in the longitudinal direction.

An apparent outer diameter of the variable-fiber-diameter bundle at the time when no energization was performed therefor was measured by a micrometer. Then, the apparent outer diameter was approximately 1860 μm.

EXAMPLE II-13

A variable-fiber-diameter bundle was obtained in a similar way to Example II-5 except for adopting a structure in which each of 40 composite fibers was wound in a spiral shape around a surface layer side of the bundle of the crimped yarns so as to be wound one time every 5 mm of a length in the longitudinal direction.

An apparent outer diameter of the variable-fiber-diameter bundle at the time when no energization was performed therefor was measured by a micrometer. Then, the apparent outer diameter was approximately 1290 μm.

EXAMPLE II-14

Electrical-conductive polymeric fibers were fabricated by a wet spinning method. Specifically, acetone (Code No. 019-00353, made by Wako Pure Chemical Industries, Ltd.) was used for a solvent phase, and a 1.3% water dispersion of PEDOTIPSS (Baytron P-AG (registered trademark) made by H.C. Starck) as an electrical-conductive polymeric component was extruded from a microsyringe (MS-GLL100 made by Ito Corporation; inner diameter of needle portion: 260 μm)

at a speed of 0.1 mL/h, whereby electrical-conductive polymeric fibers with a diameter of approximately 3 μm were obtained. Next, an aqueous polyester emulsion (AA-64, made by Nippon NSC Ltd.) was applied on surfaces of the fibers, followed by drying at 25° C. for 24 hours. Composite fibers thus obtained had a crescent cross-sectional shape of a stack type, and a diameter thereof was approximately 7 μm.

Moreover, as crimped yarns, polyester long fibers (side-by-side type, made by Kanebo Gohsen, Ltd.) with a diameter of 2 μm were used.

5500 crimped yarns described above were twisted to form a bundle, and a structure was adopted, in which, around a surface layer side of the bundle, four bundles of the composite fibers, each having two composite fibers, were wound in a spiral shape so that each of the bundles could be wound one time every 5 mm of a length in the longitudinal direction.

A variable-fiber-diameter bundle was obtained in a similar way to Example II-1 except for this condition.

An apparent outer diameter of the variable-fiber-diameter bundle at the time when no energization was performed therefor was measured by a micrometer. Then, the apparent outer diameter was approximately 770 μm.

EXAMPLE II-15

A variable-fiber-diameter bundle was obtained in a similar way to Example II-1 except for adopting a structure in which each of four composite fibers was wound in a spiral shape around a surface layer side of the bundle of the crimped yarns so as to be wound one time every 5 mm of a length in the longitudinal direction.

An apparent outer diameter of the variable-fiber-diameter bundle at the time when no energization was performed therefor was measured by a micrometer. Then, the apparent outer diameter was approximately 1610 μm.

EXAMPLE II-16

The fiber bundles composed of the crimped yarns and the composite fibers in a state before the electrodes were fixed thereto, which were fabricated in Example II-1, were cut to an average cut length of 50 mm. Then, a web was formed of mixed fibers composed of 80 mass % of the fiber bundles and 20 mass % of binder fibers [core component: PET; sheath component: copolymer polyester (amorphous polyester); softening point: 110° C.] with a diameter of 14 μm by the carding method. Then, the web was compressed to a specific thickness (approximately 8 mm), and was then heated at 160° C. for seven minutes, whereby non-woven fabric with an average apparent density of 0.025 g/cm$^3$ and a thickness of 10 mm was obtained.

This cloth was cut out to a square of 2 cm×2 cm for evaluating an airflow. Then, an electrical-conductive paste (D-500 made by Fujikura Kasei Co., Ltd.) was applied as the electrodes for the power supply connection on the positions shown in FIG. 38, and copper wires (CU-111086 made by The Nilaco Corporation) with a diameter of 0.025 mm were connected as the electric wires to the electrodes. In such a way, cloth for evaluating the airflow was obtained.

Moreover, this cloth was cut out to a circle with a diameter of 10 cm for evaluating a sound absorption coefficient. Then, in a similar way to the above, the electrodes and the electric wires for the power supply connection were arranged at the positions shown in FIG. 39. In such a way, cloth for evaluating the sound absorption coefficient was obtained.

EXAMPLE II-17

The fiber bundles composed of the crimped yarns and the composite fibers in a state before the electrodes were fixed thereto, which were fabricated in Example II-1, were used as weft yarns, and fiber bundles, in each of which 100 crimped yarns (made of PET) with a diameter of 15 μm were bundled, were used as warp yarns, whereby cloth (plain-wove fabric) in which 20 fiber bundles were arrayed per 1 cm was fabricated.

This cloth (plain-wove fabric) was cut out to a square of 2 cm×2 cm for evaluating an airflow. Then, an electrical-conductive paste (D-500 made by Fujikura Kasei Co., Ltd.) was applied as the electrodes for the power supply connection on the positions (refer to FIG. 36) on both ends of the weft yarns, and copper wires (CU-111086 made by The Nilaco Corporation) with a diameter of 0.025 mm were connected as the electric wires 86 to the electrodes. In such a way, cloth for evaluating the airflow was obtained.

EXAMPLE II-18

Cloth, airflow evaluating cloth and sound absorption coefficient evaluating cloth were obtained in a similar way to Example II-16 except that, with regard to the fiber bundles composed of the crimped yarns and the composite fibers in a state before the electrodes were fixed thereto, which were fabricated in Example II-2, an average cut length of the fiber bundles was set at 50 mm, and 80 mass % thereof was used.

EXAMPLE II-19

Cloth, airflow evaluating cloth and sound absorption coefficient evaluating cloth were obtained in a similar way to Example II-16 except that, with regard to the fiber bundles composed of the crimped yarns and the composite fibers in a state before the electrodes were fixed thereto, which were fabricated in Example II-10, an average cut length of the fiber bundles was set at 50 mm, and 80 mass % thereof was used.

EXAMPLE II-20

Cloth, airflow evaluating cloth and sound absorption coefficient evaluating cloth were obtained in a similar way to Example II-16 except that, with regard to the fiber bundles composed of the crimped yarns and the composite fibers in a state before the electrodes were fixed thereto, which were fabricated in Example II-14, an average cut length of the fiber bundles was set at 50 mm, and 80 mass % thereof was used.

COMPARATIVE EXAMPLE II-1

Fiber bundles in which the electrodes and the electric wires were arranged were obtained in a similar way to Example II-1 except for using the crimped yarns as a whole without using the composite fibers, and for using 100 PET fibers with a diameter of 15 μm, in which an average cut length was 51 mm.

COMPARATIVE EXAMPLE II-2

Fiber bundles in which the electrodes and the electric wires were arranged were obtained in a similar way to Example II-1 except for using fibers similar to those in Comparative example II-1, and for forming bundles which were not twisted.

COMPARATIVE EXAMPLE II-3

Fiber bundles in which the electrodes and the electric wires were arranged were obtained in a similar way to Example II-1 except for using eight straight yarns (made by Kanebo Gohsen, Ltd.) with a diameter of 15 μm in place of the composite fibers, and for arranging the straight yarns on the outer circumference of the crimped yarns.

COMPARATIVE EXAMPLE II-4

Fiber bundles in which the electrodes and the electric wires were arranged were obtained in a similar way to Example II-1 except for using the crimped yarns as a whole without using the composite fibers, and for using 460 PET fibers with a diameter of 7 μm, in which an average cut length was 51 mm.

COMPARATIVE EXAMPLE II-5

The fiber bundles composed of the crimped yarns in a state before the electrodes were fixed thereto, which were fabricated in Comparative example II-1, were cut to an average cut length of 50 mm. Then, a web was formed of mixed fibers composed of 80 mass % of the fiber bundles and 20 mass % of binder fibers [core component: PET; sheath component: copolymer polyester (amorphous polyester); softening point: 110° C.] with a diameter of 14 μm by the carding method. Then, the web was compressed to a specific thickness (approximately 8 mm), and was then heated at 160° C. for seven minutes, whereby non-woven fabric with an average apparent density of 0.025 g/cm$^3$ and a thickness of 10 mm was obtained.

This cloth was cut out to a square of 2 cm×2 cm for evaluating an airflow. Then, an electrical-conductive paste (D-500 made by Fujikura Kasei Co., Ltd.) was applied as the electrodes for the power supply connection on the positions shown in FIG. 38B, and copper wires (CU-111086 made by The Nilaco Corporation) with a diameter of 0.025 mm were connected as the electric wires to the electrodes. In such a way, cloth for evaluating the airflow was obtained.

Moreover, this cloth was cut out to a circle with a diameter of 10 cm for evaluating a sound absorption coefficient. Then, in a similar way to the above, the electrodes and the electric wires for the power supply connection were arranged at the positions shown in FIG. 39. In such a way, cloth for evaluating the sound absorption coefficient was obtained.

COMPARATIVE EXAMPLE II-6

The fiber bundles composed of the crimped yarns and the composite fibers in a state before the electrodes were fixed thereto, which were fabricated in Comparative example II-1, were used as weft yarns, and fiber bundles, in each of which only 100 crimped yarns with a diameter of 15 μm were bundled, were used as warp yarns, whereby cloth (plain-wove fabric) in which 20 fiber bundles were arrayed per 1 cm was fabricated.

This cloth (plain-wove fabric) was cut out to a square of 2 cm×2 cm for evaluating an airflow. Then, an electrical-conductive paste (D-500 made by Fujikura Kasei Co., Ltd.) was applied as the electrodes for the power supply connection on the positions (refer to FIGS. 36) on both ends of the weft yarns, and copper wires (CU-111086 made by The Nilaco Corporation) with a diameter of 0.025 mm were connected as the electric wires to the electrodes. In such a way, cloth for evaluating the airflow was obtained.

[Evaluation Test 1] Quantity of Airflow

Quantities of airflow in these examples were measured by an airflow testing machine FX 3300 made by TexTest, which conforms to JIS L1096 (Testing methods for woven fabrics, 8. 27. 1 method A (Frajour type testing method)), in a steady temperature and humidity room at a temperature of 20° C. and an RH of 65%.

[Evaluation Test 2] Sound Absorption Coefficient

Normal incidence sound absorption coefficients of these examples were measured by an impedance tube made by B&K in conformity with JIS A1405 (Acoustics—Determination of sound absorption coefficient and impedance in impedance tubes: Method using standing wave ratio) in a steady temperature and humidity room at a temperature of 20° C. and an RH of 65%.

Figure 42:
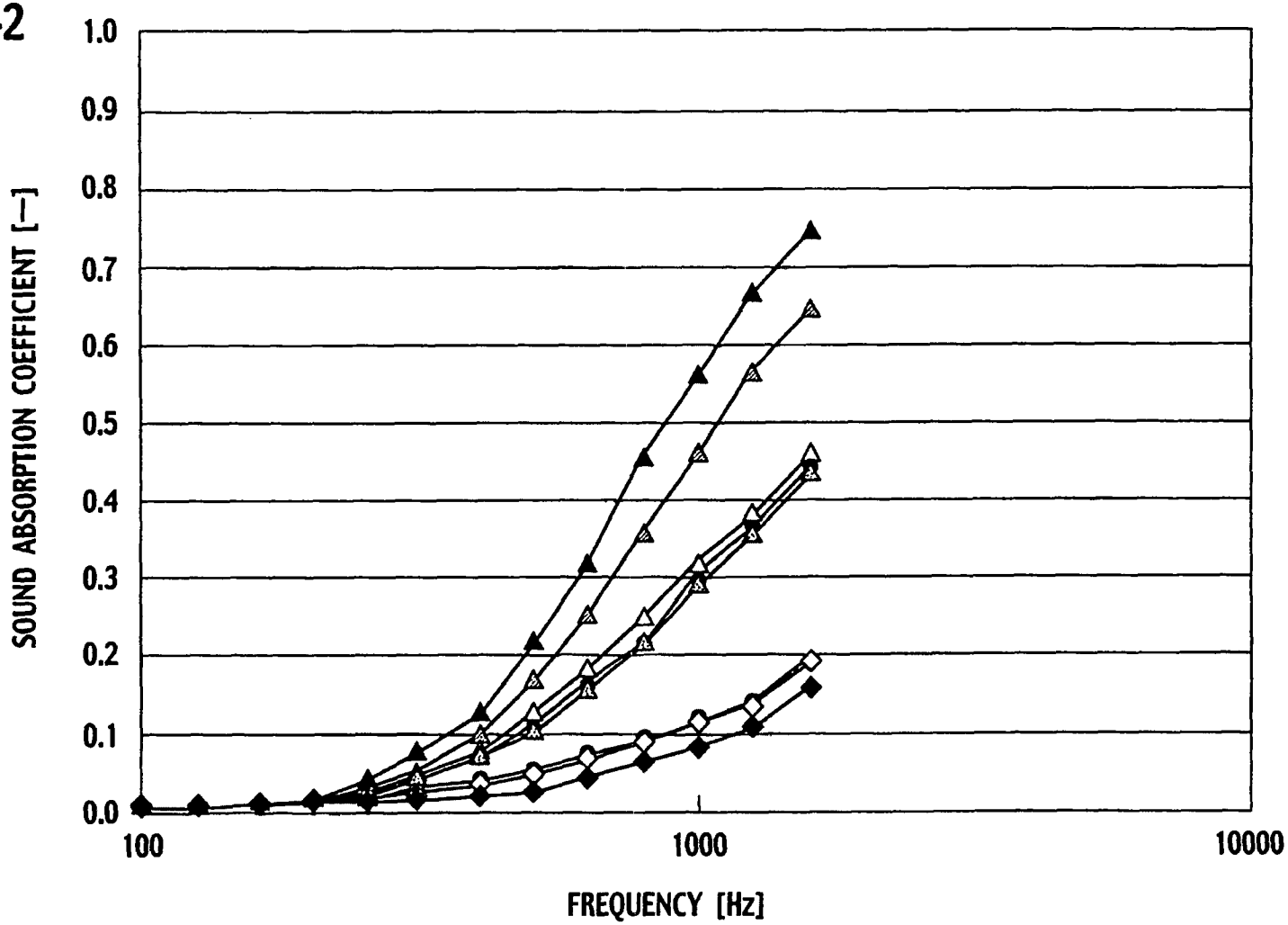
FIG. 42 is a diagram showing results of evaluating sound absorption coefficients.

Results of evaluating the sound absorption coefficients at 100 to 1600 Hz in these examples and comparative examples were plotted in FIG. 42, and the sound absorption coefficients at 1 kHz was written in Table 3.

[Evaluation Test 3] Fiber diameter

Diameters of the fiber bundles of Examples II-1 to II-15 and Comparative examples II-1 to II-4 were measured by using a micrometer under conditions of 25° C. and 60% RH.

[Energization Method]

In order to energize the samples for use in the respective evaluation tests, a direct-current regulated power supply was used. With regard to measurements in the case of turning on the power supply, the evaluations were performed on and after elapse of five minutes since the power supply was turned on.

Results of these evaluations are individually shown in Tables 2*a*, 2*b* and 3.

TABLE 2a

| | Configuration of fiber bundle | | | | | | | | |
|---|---|---|---|---|---|---|---|---|---|
| | Composite fiber | | | | Crimped yarn | | | Configuration Configuration ratio | |
| Series II | Electrical-conductive polymer | Surface layer material | Fiber diameter [μm] | Number of pieces for use in bundle | Material | Fiber diameter [μm] | Number of pieces for use in bundle | Cross-sectional area ratio [%] Composite/(Composite + Crimped) | Surface area ratio [%] Composite/(Composite + Crimped) |
| Example 1 | PEDOT/PSS | PET | 17 | 8 | PET | 15 | 92 | 8 | 22 |
| Example 2 | PEDOT/PSS | PET | 17 | 8 | PET | 7 | 450 | 8 | 22 |
| Example 3 | PEDOT/PSS | PET | 17 | 8 | PET | 15 | 1100 | 0.7 | 6 |
| Example 4 | PEDOT/PSS | PET | 17 | 16 | PET | 15 | 84 | 16 | 50 |
| Example 5 | PEDOT/PSS | PET | 17 | 40 | PET | 15 | 1100 | 3.5 | 30 |
| Example 6 | PEDOT/PSS | PET | 17 | 8 | PET | 15 | 92 | 8 | 22 |
| Example 7 | PEDOT/PSS | PET | 17 | 8 | PET | 15 | 92 | 8 | 22 |
| Example 8 | PEDOT/PSS | PET | 17 | 40 | PET | 15 | 1100 | 3.5 | — |
| Example 9 | PEDOT/PSS | PET | 17 | 8 | PET | 15 | 92 | 8 | 22 |

TABLE 2a-continued

| | Configuration of fiber bundle | | | | | | | | |
|---|---|---|---|---|---|---|---|---|---|
| | Composite fiber | | | | Crimped yarn | | | Configuration Configuration ratio | |
| Series II | Electrical-conductive polymer | Surface layer material | Fiber diameter [μm] | Number of pieces for use in bundle | Material | Fiber diameter [μm] | Number of pieces for use in bundle | Cross-sectional area ratio [%] Composite/(Composite + Crimped) | Surface area ratio [%] Composite/(Composite + Crimped) |
| Example 10 | PEDOT/PSS | PET | 17 | 40 | PET | 15 | 1100 | 3.5 | 30 |
| Example 11 | PEDOT/PSS | PET | 17 | 40 | PET | 15 | 1100 | 3.5 | 30 |
| Example 12 | PEDOT/PSS | PET | 17 | 40 | PET | 15 | 1100 | 3.5 | 30 |
| Example 13 | PEDOT/PSS | PET | 17 | 40 | PET | 2 | 1100 | 3.5 | 30 |
| Example 14 | PEDOT/PSS | PET | 7 | 8 | PET | 15 | 5500 | 2 | 10 |
| Example 15 | PEDOT/PSS | PET | 17 | 40 | PET | 15 | 1100 | 0.3 | 3 |
| Comparative Example 1 | — | — | — | — | PET | 15 | 100 | 0 | 0 |
| Comparative Example 2 | — | — | — | — | PET | 15 | 100 | 0 | 0 |
| Comparative Example 3 | — | PET | 15 | 8 | PET | 15 | 92 | 8 | 22 |
| Comparative Example 4 | — | — | — | — | PET | 7 | 460 | 0 | 0 |

TABLE 2b

| | Configuration of fiber bundle Configuration ratio | | | | Evaluation result Evaluation test 3 | |
|---|---|---|---|---|---|---|
| | | | | | Apparent outer diameter [μm] | |
| Series II | Arrangement position of composite fiber | Number of divisions on surface | Arrangement shape of composite yarn | Whether or not to be twisted | OFF time | ON (energized) time |
| Example 1 | surface layer | 4 | spiral | twisted | 590 | 160 |
| Example 2 | surface layer | 4 | spiral | twisted | 630 | 150 |
| Example 3 | surface layer | 4 | spiral | twisted | 1870 | 520 |
| Example 4 | surface layer | 4 | spiral | twisted | 410 | 150 |
| Example 5 | surface layer | 4 | spiral | twisted | 1440 | 520 |
| Example 6 | surface layer | 8 | spiral | twisted | 590 | 160 |
| Example 7 | surface layer | 4 | straight | twisted | 590 | 160 |
| Example 8 | inside | — | — | twisted | 1920 | 1500 |
| Example 9 | surface layer | 4 | spiral | not twisted | 660 | 170 |
| Example 10 | surface layer | 20 | spiral | twisted | 1350 | 600 |
| Example 11 | surface layer | 2 | spiral | twisted | 1720 | 610 |
| Example 12 | surface layer | 1 | spiral | twisted | 1860 | 650 |
| Example 13 | surface layer | 40 | spiral | twisted | 1290 | 580 |
| Example 14 | surface layer | 4 | spiral | twisted | 770 | 150 |
| Example 15 | surface layer | 4 | spiral | twisted | 1610 | 880 |
| Comparative Example 1 | — | — | — | twisted | 630 | 630 |
| Comparative Example 2 | — | — | — | not twisted | 700 | 700 |
| Comparative Example 3 | surface layer | 4 | spiral | twisted | 600 | 600 |
| Comparative Example 4 | — | — | — | twisted | 750 | 750 |

TABLE 3

| | | Evaluation test 1 Quantity of airflow [cm/s] | | Evaluation test 2 Sound Absorption coefficient [—] | |
|---|---|---|---|---|---|
| Series II | Fiber bundle for use | OFF | ON | OFF | ON |
| Example 16 | Example 1 | 63 | 155 | 0.318 | 0.117 |
| Example 17 | Example 1 | 163 | 492 | — | — |
| Example 18 | Example 2 | 57 | 158 | 0.463 | 0.116 |
| Example 19 | Example 10 | 70 | 159 | 0.294 | 0.116 |
| Example 20 | Example 14 | 53 | 199 | 0.566 | 0.087 |
| Comparative example 5 | Comparative example 1 | 61 | 61 | 0.307 | 0.307 |

TABLE 3-continued

| | | Evaluation test 1 Quantity of airflow [cm/s] | | Evaluation test 2 Sound Absorption coefficient [—] | |
|---|---|---|---|---|---|
| Series II | Fiber bundle for use | OFF | ON | OFF | ON |
| Comparative example 6 | Comparative example 1 | 61 | 61 | — | — |

From Tables 2*a*, 2*b* and 3, the following is understood.

1. When the voltage was applied to the samples, the airflows and the sound absorption coefficients were changed.

2. Any value was not changed in Comparative examples.

EXAMPLE II-21

Each cloth of Examples II-16, II-18, II-19 and II-20 and Comparative example II-6 was cut to a square of 10 cm, and was disposed on a headrest of a driver's seat of a vehicle. The cloth was energized with 12V, and ON-OFF of the energization was repeated every one minute. Then, a change of a sound pressure by an ear side of the driver's seat was able to be observed. Moreover, a passenger seated on the driver's seat was also able to sense the change. It was recognized that the cloth of the present invention was a material that repeatedly performed the increase and reduction of the sound absorption coefficient (Table 4 and FIG. 42).

TABLE 4

| Series II | Energization | Frequency [Hz] 100 | 125 | 160 | 200 | 250 | 307 | 400 | 500 | 630 | 800 | 1000 | 1250 | 1600 |
|---|---|---|---|---|---|---|---|---|---|---|---|---|---|---|
| Example 16 | ON | 0.009 | 0.009 | 0.013 | 0.018 | 0.025 | 0.027 | 0.039 | 0.059 | 0.074 | 0.092 | 0.117 | 0.141 | 0.198 |
| | OFF | 0.010 | 0.009 | 0.014 | 0.018 | 0.023 | 0.052 | 0.081 | 0.126 | 0.181 | 0.248 | 0.318 | 0.383 | 0.461 |
| Example 18 | ON | 0.011 | 0.010 | 0.016 | 0.020 | 0.021 | 0.033 | 0.043 | 0.056 | 0.072 | 0.092 | 0.116 | 0.139 | 0.191 |
| | OFF | 0.011 | 0.010 | 0.016 | 0.020 | 0.037 | 0.058 | 0.100 | 0.167 | 0.251 | 0.358 | 0.463 | 0.570 | 0.650 |
| Example 19 | ON | 0.011 | 0.010 | 0.016 | 0.020 | 0.022 | 0.025 | 0.036 | 0.050 | 0.067 | 0.092 | 0.116 | 0.139 | 0.191 |
| | OFF | 0.011 | 0.010 | 0.016 | 0.020 | 0.031 | 0.046 | 0.074 | 0.105 | 0.156 | 0.218 | 0.294 | 0.357 | 0.438 |
| Example 20 | ON | 0.011 | 0.010 | 0.016 | 0.020 | 0.017 | 0.019 | 0.026 | 0.030 | 0.048 | 0.069 | 0.087 | 0.111 | 0.156 |
| | OFF | 0.011 | 0.010 | 0.016 | 0.020 | 0.044 | 0.080 | 0.127 | 0.216 | 0.317 | 0.460 | 0.566 | 0.671 | 0.749 |
| Comparative | ON | 0.011 | 0.010 | 0.016 | 0.017 | 0.032 | 0.046 | 0.074 | 0.111 | 0.166 | 0.213 | 0.307 | 0.368 | 0.450 |
| example 5 | OFF | 0.011 | 0.010 | 0.016 | 0.017 | 0.032 | 0.046 | 0.074 | 0.111 | 0.166 | 0.213 | 0.307 | 0.368 | 0.450 |

The entire contents of Japanese Patent Application No. 2006-72628 (filed on: Mar. 16, 2006) and Japanese Patent Application No. 2006-236470 (filed on: Aug. 31, 2006) are incorporated herein by reference.

The description has been made above of the contents of the present invention along the embodiments and the examples; however, the present invention is not limited to the description of these, and it is self-evident for those skilled in the art that a variety of modifications and improvements are possible.

INDUSTRIAL APPLICABILITY

In accordance with the cloth of the present invention, in which the air permeability is variable by the energization, a material and a sound absorbing material, which have a new drive direction, can be provided. Moreover, in accordance with the present invention, the cloth in which the air permeability is variable by the energization is used, and accordingly, a sound absorbing material in which the change of the sound absorption coefficient is large can be provided. Furthermore, in accordance with the vehicular part using the cloth and/or the sound absorbing material, in which the air permeability is variable by the energization, the conventional fiber material is replaced by the cloth and/or the sound absorbing material, thus making it possible to impart a new function to the fiber product.

The invention claimed is:

1. Cloth in which air permeability is variable by energization, the cloth comprising:

a fibrous object comprising composite fibers, the composite fibers comprising: an electrical-conductive polymeric material formed of a polymer which is electrically conductive; and a material different from the electrical-conductive polymeric material, the different material being in direct contact with the electrical-conductive polymeric material;

electrodes which are attached to the fibrous object, and through which an electric current flows to the electrical-conductive polymeric material; and a power supply which applies the electric current to the electrical-conductive polymeric material through the electrodes, wherein the composite fibers have a structure in which the material different from the electrical-conductive polymeric material is stacked on at least a part of a surface of the electrical-conductive polymeric material, or a structure in which either one of the electrical-conductive polymeric material and the material different from the electrical-conductive polymeric material penetrates the other material in a longitudinal direction, wherein when the power supply applies the electric current to the electrical-conductive polymeric material, the electrical-conductive polymeric material shrinks, and the electrical-conductive polymeric material causes a length difference from the material different from the electrical-conductive polymeric material, and wherein the composite fibers are arranged such that an air permeability or a sound absorption of the cloth is changed when the power supply applies the electric current.

2. The cloth according to claim 1, wherein the composite fibers have the structure in which the material different from the electrical-conductive polymeric material is stacked on at least a part of the surface of the electrical-conductive polymeric material, and each of the composite fibers is composed in such a manner that the electrical-conductive polymeric material and the material different from the electrical-conductive polymeric material are bonded to each other in a side-by-side type.

3. The cloth according to claim 1, wherein the composite fibers have the structure in which either one of the electrical-conductive polymeric material and the material different from the electrical-conductive polymeric material penetrates the other material in the longitudinal direction, and the structure is of a core-sheath type.

4. The cloth according to claim 1, wherein the material different from the electrical-conductive polymeric material is a resin material.

5. The cloth according to claim 4, wherein the resin material is thermoplastic resin.

6. The cloth according to claim 1, wherein the fibrous object is composed by bundling the composite fibers as twisted yarns.

7. The cloth according to claim 1, wherein the fibrous object is composed of single fibers of the composite fibers.

8. The cloth according to claim 1, wherein the fibrous object comprises fiber bundles of the composite fibers.

9. The cloth according to claim 8, wherein the fibrous object further comprises crimped yarns composed of a material that does not contain an electrical-conductive polymer.

10. The cloth according to claim 8, wherein each of the fiber bundles is composed in such a manner that the composite fibers are arranged on a surface layer side of the fiber bundle.

11. The cloth according to claim 8, wherein each of the fiber bundles is composed in such a manner that the composite fibers arc arranged in a spiral shape on a surface layer side of the fiber bundle.

12. The cloth according to claim 8, wherein the composite fibers are arranged to divide a surface of each of the fiber bundles into two to twenty equal parts of the surface on an outer circumference of the fiber bundle.

13. The cloth according to claim 8, wherein the composite fibers occupy an area of 0.1% or more to 20% or less with respect to a total cross-sectional area of fibers composing each of the fiber bundles.

14. The cloth according to claim 8, wherein the composite fibers occupy an area of 0.1% or more to 50% or less with respect to a total cross-sectional area of fibers composing each of the fiber bundles.

15. A sound absorbing material comprising: the cloth according to claim 1.

16. A vehicular part comprising: the cloth according to claim 1.

17. A vehicular part comprising: the sound absorbing material according to claim 15.

18. Cloth in which air permeability is variable by energization, the cloth comprising:

a fibrous object comprising composite fibers, the composite fibers comprising: an electrical-conductive polymeric fiber formed of an electrical-conductive polymeric material; and a polymeric fiber formed of a material different from the electrical-conductive polymeric material, the polymeric fiber being in direct contact with and formed on a surface of the electrical-conductive polymeric fiber, wherein the fibrous object is allowed to shrink in response to an electrical current supplied through the electrical-conductive polymeric fiber;

electrodes which are attached to the fibrous object, and through which an electric current flows to the electrical-conductive polymeric fiber; and a power supply which applies the electric current to the electrical-conductive polymeric fiber through the electrodes, wherein the composite fibers have a structure in which the polymeric fiber is stacked on at least a part of a surface of the electrical-conductive polymeric fiber, or a structure in which either one of the electrical-conductive polymeric fiber and the polymeric fiber penetrates the other fiber in a longitudinal direction, wherein when the power supply applies the electric current to the electrical-conductive polymeric fiber, the electrical-conductive polymeric fiber shrinks, and the electrical-conductive polymeric fiber causes a length difference from the polymeric fiber, and wherein the composite fibers are arranged such that an air permeability or a sound absorption of the cloth is changed when the power supply applies the electric current.

* * * * *